US010239230B2

(12) United States Patent
Li et al.

(10) Patent No.: US 10,239,230 B2
(45) Date of Patent: Mar. 26, 2019

(54) SLURRY DISTRIBUTOR, SYSTEM AND METHOD FOR USING SAME

(71) Applicant: United States Gypsum Company, Chicago, IL (US)

(72) Inventors: Alfred Li, Naperville, IL (US); Chris C. Lee, Deerfield, IL (US); Cesar Chan, Libertyville, IL (US); Ronald E. Schenck, Valparaiso, IN (US); Weixin David Song, Shanghai (CN); Curtis B. Loring, Valparaiso, IN (US); James R. Wittbold, Des Plaines, IL (US); William J. Rago, Gurnee, IL (US); Christopher Robert Nelson, Lindenhurst, IL (US)

(73) Assignee: United States Gypsum Company, Chicago, IL (US)

( * ) Notice: Subject to any disclaimer, the term of this patent is extended or adjusted under 35 U.S.C. 154(b) by 0 days.

(21) Appl. No.: 15/483,585

(22) Filed: Apr. 10, 2017

(65) Prior Publication Data

US 2017/0210029 A1 Jul. 27, 2017

Related U.S. Application Data

(62) Division of application No. 13/341,209, filed on Dec. 30, 2011, now Pat. No. 9,616,591.
(Continued)

(51) Int. Cl.
*B28B 19/00* (2006.01)
*B05C 5/02* (2006.01)

(52) U.S. Cl.
CPC ..... *B28B 19/0092* (2013.01); *B05C 5/0245* (2013.01); *B05C 5/0254* (2013.01);
(Continued)

(58) Field of Classification Search
CPC . B28B 19/0092; B05C 5/0245; B05C 5/0254; B05C 5/0262; B05C 5/0225; Y10T 137/0318
See application file for complete search history.

(56) References Cited

U.S. PATENT DOCUMENTS 1,452,702 A 4/1923 Pipe
1,905,733 A 4/1933 Moore
(Continued)

FOREIGN PATENT DOCUMENTS

AT 402826 B 7/1997
CN 1954166 A 4/2007
(Continued)

OTHER PUBLICATIONS

Durst, WO201020594.*
(Continued)

*Primary Examiner* — Anshu Bhatia
(74) *Attorney, Agent, or Firm* — Leydig, Voit & Mayer, Ltd.; Philip T. Petti; Pradip K. Sahu

(57) ABSTRACT

A slurry distribution system can include a feed conduit and a distribution conduit in fluid communication therewith. The feed conduit can include a first feed inlet and a second feed inlet disposed in spaced relationship thereto. The distribution conduit can extend generally along a longitudinal axis and include an entry portion and a distribution outlet in fluid communication therewith. The entry portion is in fluid communication with the first and second feed inlets of the feed conduit. The distribution outlet extends a predetermined distance along a transverse axis, which is substantially perpendicular to the longitudinal axis. The slurry distribution system can be placed in fluid communication
(Continued)

with a gypsum slurry mixer adapted to agitate water and calcined gypsum to form an aqueous calcined gypsum slurry.

9 Claims, 23 Drawing Sheets

Related U.S. Application Data

(60) Provisional application No. 61/428,706, filed on Dec. 30, 2010, provisional application No. 61/428,736, filed on Dec. 30, 2010, provisional application No. 61/550,827, filed on Oct. 24, 2011, provisional application No. 61/550,857, filed on Oct. 24, 2011, provisional application No. 61/550,873, filed on Oct. 24, 2011.

(52) U.S. Cl.
CPC ..... *B05C 5/0262* (2013.01); *B05C 5/0225* (2013.01); *Y10T 137/0318* (2015.04); *Y10T 137/87571* (2015.04)

(56) References Cited

U.S. PATENT DOCUMENTS 2,097,613 A 11/1937 Batcheller
2,203,072 A 6/1940 Albright
2,660,416 A 11/1953 Camp et al.
2,700,622 A 1/1955 Burwell
2,882,716 A 4/1959 Anderson
2,998,198 A 8/1961 Young
3,053,314 A 9/1962 McGillis et al.
3,083,756 A 4/1963 Page et al.
3,196,864 A 7/1965 Wallace
3,198,867 A 8/1965 Siggers
3,266,974 A 8/1966 Staver
3,296,346 A 1/1967 Shannon
3,297,601 A 1/1967 Ptasieaski et al.
3,359,146 A 12/1967 Lane et al.
3,363,769 A 1/1968 Wilmot et al.
3,380,333 A 4/1968 Clay et al.
3,400,190 A 9/1968 Donald
3,415,920 A 12/1968 Lee et al.
3,432,588 A 3/1969 Breidt et al.
3,437,172 A 4/1969 Allen
3,458,907 A 8/1969 Shannon
3,459,620 A 8/1969 McCleary et al.
3,467,281 A 9/1969 Archer
3,494,993 A 2/1970 Breidt et al.
3,532,781 A 10/1970 Shannon
3,558,380 A 1/1971 Pook
3,583,681 A 6/1971 Brown
3,602,405 A 8/1971 Ames
3,644,169 A 2/1972 Phillips
3,663,562 A 5/1972 Magerlein et al.
3,740,027 A 6/1973 Kormos
3,760,036 A 9/1973 Matthews
3,781,320 A 12/1973 Irwin
3,795,259 A 3/1974 Bradin et al.
3,841,530 A 10/1974 Janninck
3,909,170 A 9/1975 Riboulet et al.
3,959,431 A 5/1976 Nissel
3,959,432 A 5/1976 Wiley
4,110,061 A 8/1978 Gerritsen
4,113,829 A 9/1978 Bowker et al.
4,153,403 A 5/1979 Schneider
4,175,591 A 11/1979 Welker
4,181,647 A 1/1980 Beach
4,187,275 A 2/1980 Bracalielly et al.
4,190,144 A 2/1980 Lybbert
4,268,236 A 5/1981 Peille et al.
4,279,673 A 7/1981 White et al.
4,288,263 A 9/1981 Delcoigne et al.
4,334,786 A 6/1982 Delcoigne et al.
4,354,885 A 10/1982 White
4,361,254 A 11/1982 Teraoku et al.
4,364,790 A 12/1982 Delcoigne et al.
4,392,613 A 7/1983 Graff et al.
4,474,477 A 10/1984 Smith et al.
4,533,300 A 8/1985 Westerlund et al.
4,557,261 A 12/1985 Rugheimer
4,588,299 A 5/1986 Brown et al.
4,618,294 A 10/1986 Brown
4,664,611 A 5/1987 Kumar
4,758,261 A 7/1988 Parker et al.
4,819,878 A 4/1989 Bailey et al.
4,827,921 A 5/1989 Rugheimer
4,934,596 A 6/1990 Hilton et al.
4,942,003 A 7/1990 Bold
5,188,455 A 2/1993 Hammerstedt
5,192,384 A 3/1993 Barrier et al.
5,211,511 A 5/1993 Deal, Jr.
5,211,965 A 5/1993 Kitagawa
5,261,485 A 11/1993 Thornton et al.
5,316,703 A 5/1994 Schrenk
5,320,677 A 6/1994 Baig
5,350,290 A 9/1994 Honings
5,386,943 A 2/1995 Peeters
5,395,653 A 3/1995 Baum
5,508,072 A 4/1996 Andersen et al.
5,520,779 A 5/1996 Bold
5,580,409 A 12/1996 Andersen et al.
5,582,670 A 12/1996 Andersen et al.
5,622,729 A 4/1997 Mower
5,643,510 A 7/1997 Sucech
5,660,903 A 8/1997 Andersen et al.
5,660,904 A 8/1997 Andersen et al.
5,665,442 A 9/1997 Andersen et al.
5,679,381 A 10/1997 Andersen et al.
5,683,635 A 11/1997 Sucech et al.
5,709,593 A 1/1998 Guthrie et al.
5,714,001 A 2/1998 Savoly et al.
5,718,797 A 2/1998 Phillips et al.
5,720,913 A 2/1998 Andersen et al.
5,730,819 A 3/1998 Retti
5,766,525 A 6/1998 Andersen et al.
5,792,322 A 8/1998 Hergert et al.
5,794,642 A 8/1998 Zikeli et al.
5,800,647 A 9/1998 Andersen et al.
5,844,051 A 12/1998 Onzuka et al.
5,879,486 A 3/1999 Philips et al.
5,879,722 A 3/1999 Andersen et al.
5,908,240 A 6/1999 Hood et al.
5,972,426 A 10/1999 Kutsuzawa et al.
5,997,691 A 12/1999 Gautam et al.
6,057,000 A 5/2000 Cai
6,059,444 A 5/2000 Johnson et al.
6,123,445 A 9/2000 Grassi
6,153,040 A 11/2000 Rohlf et al.
6,154,947 A 12/2000 Koebbe
6,176,036 B1 1/2001 Pease
6,276,946 B1 8/2001 Stephan
6,286,422 B1 9/2001 Lin et al.
6,323,159 B1 11/2001 Raza
6,340,123 B1 1/2002 Lee et al.
6,342,284 B1 1/2002 Yu et al.
6,363,967 B1 4/2002 Tanaka et al.
6,382,922 B1 5/2002 Lewis et al.
6,402,062 B1 6/2002 Bendig et al.
6,409,823 B1 6/2002 Shake et al.
6,416,695 B1 * 7/2002 Miller ..... B28B 1/526 156/39
6,427,877 B1 8/2002 Trout
6,471,799 B1 10/2002 Sasaki et al.
6,494,609 B1 12/2002 Wittbold et al.
6,524,388 B1 2/2003 Yamada et al.
6,616,985 B2 9/2003 Powell et al.
6,632,550 B1 10/2003 Yu et al.
6,635,214 B2 10/2003 Rapacki et al.
6,645,483 B2 11/2003 McGhee
6,699,364 B2 3/2004 Song et al.
6,699,426 B1 3/2004 Burke

(56) References Cited

U.S. PATENT DOCUMENTS

| | | | |
|---|---|---|---|
| 6,752,895 | B1 | 6/2004 | Song et al. |
| 6,774,146 | B2 | 8/2004 | Savoly et al. |
| 6,800,131 | B2 | 10/2004 | Yu et al. |
| 6,872,280 | B2 | 3/2005 | Tanaka et al. |
| 6,874,930 | B2 | 4/2005 | Wittbold et al. |
| 6,878,321 | B2 | 4/2005 | Hauber et al. |
| 7,007,914 | B2 | 3/2006 | Petersen et al. |
| 7,127,865 | B2 | 10/2006 | Douglas |
| 6,991,361 | B2 | 12/2006 | Flood |
| 7,160,389 | B2 | 1/2007 | Gibson et al. |
| 7,172,403 | B2 | 2/2007 | Burke |
| 7,255,123 | B2 | 8/2007 | Cedergaard et al. |
| 7,296,919 | B2 | 11/2007 | Petersen et al. |
| 7,364,676 | B2 | 4/2008 | Sucech |
| 7,458,532 | B2 | 12/2008 | Sloan |
| 7,475,599 | B2 | 1/2009 | Frank et al. |
| 7,588,634 | B2 | 9/2009 | Lynn et al. |
| 7,690,834 | B2 | 4/2010 | Nakamura et al. |
| 7,718,019 | B2 | 5/2010 | Wittbold et al. |
| 7,731,794 | B2 | 6/2010 | Yu et al. |
| 7,736,720 | B2 | 6/2010 | Yu et al. |
| 7,771,851 | B2 | 8/2010 | Song et al. |
| 7,875,114 | B2 | 1/2011 | Wittbold et al. |
| 7,875,192 | B2 | 1/2011 | Eigenmann et al. |
| 7,980,922 | B2 | 7/2011 | Kiesel et al. |
| 8,016,960 | B2 | 9/2011 | Wittbold et al. |
| 8,030,377 | B2 | 10/2011 | Dubey et al. |
| 8,038,790 | B1 | 10/2011 | Dubey et al. |
| 8,057,915 | B2 | 11/2011 | Song et al. |
| 8,062,741 | B2 | 11/2011 | Tonyan et al. |
| 8,088,218 | B2 | 1/2012 | Blackburn et al. |
| 8,119,207 | B2 | 2/2012 | Rigaudon et al. |
| 8,128,126 | B2 | 3/2012 | Poupore et al. |
| 8,142,859 | B2 | 3/2012 | Domey et al. |
| 8,142,915 | B2 | 3/2012 | Blackburn et al. |
| 8,177,541 | B2 | 5/2012 | Fahey |
| 8,197,952 | B2 | 6/2012 | Yu et al. |
| 8,257,489 | B2 | 9/2012 | Yu et al. |
| 8,360,825 | B2 | 1/2013 | Hsu et al. |
| 8,444,787 | B2 | 5/2013 | Wittbold et al. |
| 8,475,762 | B2 | 7/2013 | Li et al. |
| 8,597,426 | B2 | 12/2013 | Lee et al. |
| 8,685,188 | B2 | 4/2014 | Yamaji et al. |
| 8,801,852 | B2 | 8/2014 | Lee et al. |
| 9,296,124 | B2 | 3/2016 | Rago et al. |
| 2002/0045074 | A1 | 4/2002 | Yu et al. |
| 2002/0056690 | A1 | 5/2002 | Wegner |
| 2003/0049450 | A1 | 3/2003 | Song et al. |
| 2003/0068959 | A1 | 4/2003 | Kajiwara et al. |
| 2003/0117891 | A1 | 6/2003 | Wittbold et al. |
| 2003/0200714 | A1 | 10/2003 | Minke et al. |
| 2004/0033314 | A1 | 2/2004 | Rao et al. |
| 2004/0033324 | A1 | 2/2004 | Meyer |
| 2004/0091406 | A1 | 5/2004 | Wolfert et al. |
| 2004/0231916 | A1 | 11/2004 | Englert et al. |
| 2005/0019618 | A1 | 1/2005 | Yu et al. |
| 2005/0103347 | A1 | 5/2005 | Curti et al. |
| 2005/0253098 | A1 | 11/2005 | Petersen et al. |
| 2006/0035112 | A1 | 2/2006 | Veeramasuneni et al. |
| 2006/0092759 | A1 | 5/2006 | Petersen et al. |
| 2006/0198995 | A1 | 9/2006 | Nideborn et al. |
| 2006/0243171 | A1 | 11/2006 | Yu et al. |
| 2006/0244182 | A1 | 11/2006 | Wittbold et al. |
| 2006/0244183 | A1 | 11/2006 | Wittbold et al. |
| 2006/0278133 | A1 | 12/2006 | Yu et al. |
| 2006/0283974 | A1 | 12/2006 | Eguchi et al. |
| 2007/0022913 | A1 | 2/2007 | Wang et al. |
| 2007/0048490 | A1 | 3/2007 | Yu et al. |
| 2007/0048549 | A1 | 3/2007 | Song et al. |
| 2007/0059513 | A1 | 3/2007 | Yu et al. |
| 2007/0251628 | A1 | 11/2007 | Yu et al. |
| 2008/0000392 | A1 | 1/2008 | Blackburn et al. |
| 2008/0009565 | A1 | 1/2008 | Wittbold et al. |
| 2008/0069762 | A1 | 3/2008 | Lynn et al. |
| 2008/0090068 | A1 | 4/2008 | Yu et al. |
| 2008/0110276 | A1 | 5/2008 | Frank et al. |
| 2008/0141909 | A1 | 6/2008 | Immordino et al. |
| 2008/0299413 | A1 | 12/2008 | Song et al. |
| 2009/0090796 | A1 | 4/2009 | Tian |
| 2009/0134550 | A1 | 5/2009 | Dehennau et al. |
| 2009/0239977 | A1 | 9/2009 | Dubey et al. |
| 2009/0257303 | A1 | 10/2009 | Rayner et al. |
| 2009/0297765 | A1 | 12/2009 | Domey et al. |
| 2010/0077939 | A1 | 4/2010 | Trout |
| 2010/0081008 | A1 | 4/2010 | Trout |
| 2010/0139528 | A1 | 6/2010 | Yu et al. |
| 2010/0227073 | A1 | 9/2010 | Frank et al. |
| 2010/0229714 | A1 | 9/2010 | Tonyan et al. |
| 2010/0239886 | A1 | 9/2010 | Yu et al. |
| 2010/0291305 | A1 | 11/2010 | Wittbold et al. |
| 2011/0054053 | A1 | 3/2011 | Lee et al. |
| 2011/0186664 | A1 | 8/2011 | Lucas et al. |
| 2011/0192518 | A1 | 8/2011 | Li |
| 2011/0195241 | A1 | 8/2011 | Yu et al. |
| 2011/0211418 | A1 | 9/2011 | Tassone et al. |
| 2011/0213043 | A1 | 9/2011 | Blackburn et al. |
| 2011/0213085 | A1 | 9/2011 | Tonelli et al. |
| 2011/0220586 | A1 | 9/2011 | Levitt |
| 2011/0271903 | A1 | 11/2011 | Durst et al. |
| 2011/0308432 | A1 | 12/2011 | Wittbold et al. |
| 2012/0131857 | A1 | 5/2012 | Ross-da Silva |
| 2012/0167805 | A1 | 7/2012 | Wittbold et al. |
| 2012/0168527 | A1 | 7/2012 | Li et al. |
| 2012/0170403 | A1 | 7/2012 | Li et al. |
| 2012/0251813 | A1 | 10/2012 | Yu et al. |
| 2012/0304545 | A1 | 12/2012 | Park et al. |
| 2012/0308463 | A1 | 12/2012 | Li et al. |
| 2013/0098268 | A1 | 4/2013 | Li et al. |
| 2013/0099027 | A1 | 4/2013 | Li et al. |
| 2013/0099418 | A1 | 4/2013 | Li et al. |
| 2013/0100759 | A1 | 4/2013 | Wittbold et al. |
| 2013/0216717 | A1 | 8/2013 | Rago et al. |
| 2013/0233880 | A1 | 9/2013 | Rago et al. |
| 2013/0308411 | A1 | 11/2013 | Wittbold et al. |
| 2014/0073711 | A1 | 3/2014 | Lee et al. |
| 2014/0090730 | A1 | 4/2014 | Buettner et al. |
| 2015/0231799 | A1 | 8/2015 | Wittbold et al. |
| 2017/0210029 | A1 | 7/2017 | Li et al. |

FOREIGN PATENT DOCUMENTS

| | | | |
|---|---|---|---|
| CN | 2928447 | Y | 8/2007 |
| CN | 201015893 | Y | 2/2008 |
| CN | 201685321 | U | 12/2010 |
| CN | 203266908 | U | 11/2013 |
| CN | 204076480 | U | 1/2015 |
| CN | 203957095 | U | 11/2016 |
| DE | 353695 | | 5/1922 |
| DE | 3808698 | A1 | 9/1989 |
| DE | 3932573 | A1 | 4/1991 |
| DE | 29514043 | U1 | 11/1995 |
| DE | 19757678 | A1 | 6/1999 |
| DE | 102008041423 | A1 | 2/2010 |
| DE | 202009014417 | U1 | 2/2010 |
| DE | 202011100879 | U1 | 6/2011 |
| DE | 102010010872 | A1 | 9/2011 |
| EP | 0003705 | | 2/1979 |
| EP | 0225261 | A1 | 6/1987 |
| EP | 0997784 | A1 | 5/2000 |
| EP | 1085280 | A1 | 3/2001 |
| EP | 1396696 | A2 | 3/2004 |
| EP | 1491262 | A2 | 12/2004 |
| EP | 2363269 | A1 | 9/2011 |
| EP | 2514294 | | 10/2012 |
| FR | 1357221 | | 4/1964 |
| FR | 2112808 | A5 | 6/1972 |
| GB | 1317359 | A | 5/1973 |
| GB | 1420686 | | 1/1976 |
| GB | 1520258 | A | 8/1978 |
| GB | 2026372 | A | 2/1980 |
| GB | 2044163 | A | 10/1980 |
| GB | 2246694 | A | 2/1992 |
| GB | 2410909 | | 8/2005 |
| JP | 51-90356 | U | 7/1976 |

(56) References Cited

FOREIGN PATENT DOCUMENTS

| | | | |
|---|---|---|---|
| JP | H0-6190845 | A | 7/1994 |
| JP | H0-752130 | A | 2/1995 |
| JP | H0788419 | A | 4/1995 |
| JP | H08-281626 | A | 10/1996 |
| JP | 9094814 | A | 4/1997 |
| JP | H09141700 | A | 6/1997 |
| JP | 9273421 | A | 10/1997 |
| JP | H11-501002 | A | 1/1999 |
| JP | 11148589 | | 6/1999 |
| JP | H11-170235 | A | 6/1999 |
| JP | H11-188301 | A | 7/1999 |
| JP | 2000-505163 | A | 4/2000 |
| JP | 2001-062821 | A | 3/2001 |
| JP | 2001-300933 | A | 10/2001 |
| JP | 2004130672 | | 4/2004 |
| JP | 2005-021894 | A | 1/2005 |
| JP | 2005-211871 | A | 8/2005 |
| JP | 2006095469 | A | 4/2006 |
| JP | 2006334483 | A | 12/2006 |
| JP | 2008-229560 | A | 10/2008 |
| JP | 2009-045513 | A | 3/2009 |
| RU | 2257294 | A | 5/2005 |
| RU | 2313451 | C2 | 12/2007 |
| SU | 1033204 | A1 | 8/1983 |
| TW | I350228 | B | 10/2011 |
| WO | WO 1993024290 | | 12/1993 |
| WO | WO 97/05305 | A1 | 2/1997 |
| WO | WO 98/25069 | | 6/1998 |
| WO | WO 2004/101402 | | 11/2004 |
| WO | WO 2006/137800 | A2 | 12/2006 |
| WO | WO 2010/142034 | | 12/2010 |
| WO | WO 2011134844 | | 11/2011 |
| WO | WO 2011150455 | | 12/2011 |
| WO | WO 2012076526 | | 6/2012 |
| WO | WO 2012/092534 | A1 | 7/2012 |
| WO | WO 2012/092582 | A1 | 7/2012 |
| WO | WO 2013/063044 | A1 | 5/2013 |
| WO | WO 2013/063055 | A2 | 5/2013 |
| WO | WO 2013/063073 | A2 | 5/2013 |
| WO | WO 2013/063080 | A2 | 5/2013 |
| WO | WO 2013/063055 | A3 | 6/2013 |
| WO | WO 2014/066211 | A1 | 5/2014 |
| WO | WO 2014/066283 | A1 | 5/2014 |

OTHER PUBLICATIONS

Machine Translation for Durst 201020594.*

Burrows, "A Decade's Experience of Gypsum Board Weight Reduction in the U.S.", 14. Internationale Baustofftagung (Weimar, Sep. 20-23, 2000), 1.0197-1.0207.

Mueller et al., "Controlling Set Times during Gypsum Board Production: Advance Additive Solutions", Global Gypsum Conference, Oct. 2011.

Peterson, Kurt, "Engineered Gypsum Panels, the Development and Application of Densified Zones at the Paper/Core Interface of Gypsum Panels", Proceedings of Gypsum 2000, 6th International Conference on Natural and Synthetic Gypsum, Toronto, Canada, May 2000, pp. 9-1-9-16.

Teejet; "TeeJet LF 500 Slurry Controller," http://teejet.com/english/home/products/application-control-and-equipment/slurry-application-controls/teejet--lh-500-slurry-controller.aspx, accessed Jan. 8, 2015.

European Patent Office, International Search Report and Written Opinion in International Application No. PCT/US2011/068033 (dated May 3, 2012).

European Patent Office, International Search Report and Written Opinion in International Application No. PCT/US2011/068167 (dated May 11, 2012).

* cited by examiner

SLURRY DISTRIBUTOR, SYSTEM AND METHOD FOR USING SAME

CROSS-REFERENCE TO RELATED APPLICATIONS

This patent application is a divisional of U.S. patent application Ser. No. 13/341,209, filed Dec. 30, 2011, and entitled, "Slurry Distributor, System, Method For Using, And Method For Making Same," which is incorporated in its entirety herein by this reference and which claims the benefit of priority to U.S. Provisional Patent Application Nos.

61/428,706, filed Dec. 30, 2010, and entitled, "Slurry Distributor, System and Method for Using Same";

61/428,736, filed Dec. 30, 2010, and entitled, "Slurry Distribution System and Method";

61/550,827, filed Oct. 24, 2011, and entitled. "Slurry Distributor, System, Method for Using, and Method for Making Same";

61/550,857, filed Oct. 24, 2011, and entitled, "Flow Splitter for Slurry Distribution System"; and 61/550,873, filed Oct. 24, 2011, and entitled. "Automatic Device for Squeezing Slurry Splitter,"

which are incorporated in their entireties herein by this reference.

BACKGROUND

The present disclosure relates to continuous board (e.g., wallboard) manufacturing processes and, more particularly, to an apparatus, system and method for the distribution of an aqueous calcined gypsum slurry.

It is well-known to produce gypsum board by uniformly dispersing calcined gypsum (commonly referred to as "stucco") in water to form an aqueous calcined gypsum slurry. The aqueous calcined gypsum slurry is typically produced in a continuous manner by inserting stucco and water and other additives into a mixer which contains means for agitating the contents to form a uniform gypsum slurry. The slurry is continuously directed toward and through a discharge outlet of the mixer and into a discharge conduit connected to the discharge outlet of the mixer. An aqueous foam can be combined with the aqueous calcined gypsum slurry in the mixer and/or in the discharge conduit. The stream of slurry passes through the discharge conduit from which it is continuously deposited onto a moving web of cover sheet material supported by a forming table. The slurry is allowed to spread over the advancing web. A second web of cover sheet material is applied to cover the slurry and form a sandwich structure of a continuous wallboard preform, which is subjected to forming, such as at a conventional forming station, to obtain a desired thickness. The calcined gypsum reacts with the water in the wallboard preform and sets as the wallboard preform moves down a manufacturing line. The wallboard preform is cut into segments at a point along the line where the wallboard preform has set sufficiently, the segments are flipped over, dried (e.g., in a kiln) to drive off excess water, and processed to provide the final wallboard product of desired dimensions.

Prior devices and methods for addressing some of the operational problems associated with the production of gypsum wallboard are disclosed in commonly-assigned U.S. Pat. Nos. 5,683,635; 5,643,510; 6,494,609; 6,874,930; 7,007,914; and 7,296,919, which are incorporated herein by reference.

The weight proportion of water relative to stucco that is combined to form a given amount of finished product is often referred to in the art as the "water-stucco ratio" (WSR). A reduction in the WSR without a formulation change will correspondingly increase the slurry viscosity, thereby reducing the ability of the slurry to spread on the forming table. Reducing water usage (i.e., lowering the WSR) in the gypsum board manufacturing process can yield many advantages, including the opportunity to reduce the energy demand in the process. However, spreading increasingly viscous gypsum slurries uniformly on the forming table remains a great challenge.

Furthermore, in some situations where the slurry is a multi-phase slurry including air, air-liquid slurry separation can develop in the slurry discharge conduit from the mixer. As WSR decreases, the air volume increases to maintain the same dry density. The degree of air phase separated from the liquid slurry phase increases, thereby resulting in the propensity for larger mass or density variation.

It will be appreciated that this background description has been created by the inventors to aid the reader and is not to be taken as an indication that any of the indicated problems were themselves appreciated in the art. While the described principles can, in some aspects and embodiments, alleviate the problems inherent in other systems, it will be appreciated that the scope of the protected innovation is defined by the attached claims and not by the ability of any disclosed feature to solve any specific problem noted herein.

SUMMARY

In one aspect, the present disclosure is directed to embodiments of a slurry distribution system for use in preparing a gypsum product. In one embodiment, a slurry distributor can include a feed conduit and a distribution conduit in fluid communication therewith. The feed conduit can include a first feed inlet in fluid communication with the distribution conduit and a second feed inlet disposed in spaced relationship with the first feed inlet and in fluid communication with the distribution conduit. The distribution conduit can extend generally along a longitudinal axis and include an entry portion and a distribution outlet in fluid communication therewith. The entry portion is in fluid communication with the first and second feed inlets of the feed conduit. The distribution outlet extends a predetermined distance along a transverse axis, which is substantially perpendicular to the longitudinal axis.

In another aspect of the present disclosure, a slurry distributor can be placed in fluid communication with a gypsum slurry mixer adapted to agitate water and calcined gypsum to form an aqueous calcined gypsum slurry. In one embodiment, the disclosure describes a gypsum slurry mixing and dispensing assembly which includes a gypsum slurry mixer adapted to agitate water and calcined gypsum to form an aqueous calcined gypsum slurry. A slurry distributor is in fluid communication with the gypsum slurry mixer and is adapted to receive a first flow and a second flow of aqueous calcined gypsum slurry from the gypsum slurry mixer and distribute the first and second flows of aqueous calcined gypsum slurry onto an advancing web.

The slurry distributor includes a first feed inlet adapted to receive the first flow of aqueous calcined gypsum slurry from the gypsum slurry mixer, a second feed inlet adapted to receive the second flow of aqueous calcined gypsum slurry from the gypsum slurry mixer, and a distribution outlet in fluid communication with both the first and the second feed inlets and adapted such that the first and second flows of aqueous calcined gypsum slurry discharge from the slurry distributor through the distribution outlet.

In still another aspect of the present disclosure, the slurry distribution system can be used in a method of preparing a gypsum product. For example, a slurry distributor can be used to distribute an aqueous calcined gypsum slurry upon an advancing web.

In one embodiment, a method of distributing an aqueous calcined gypsum slurry upon a moving web can be performed using a slurry distributor constructed according to principles of the present disclosure. A first flow of aqueous calcined gypsum slurry and a second flow of aqueous calcined gypsum slurry are respectively passed through a first feed inlet and a second feed inlet of the slurry distributor. The first and second flows of aqueous calcined gypsum slurry are combined in the slurry distributor. The first and second flows of aqueous calcined gypsum slurry are discharged from a distribution outlet of the slurry distributor upon the moving web.

Further and alternative aspects and features of the disclosed principles will be appreciated from the following detailed description and the accompanying drawings. As will be appreciated, the slurry distribution systems disclosed herein are capable of being carried out and used in other and different embodiments, and capable of being modified in various respects. Accordingly, it is to be understood that both the foregoing general description and the following detailed description are exemplary and explanatory only and do not restrict the scope of the appended claims.

DETAILED DESCRIPTION OF EXEMPLARY EMBODIMENTS

The present disclosure provides various embodiments of a slurry distribution system that can be used in the manufacture of products, including cementitious products such as gypsum wallboard, for example. Embodiments of a slurry distributor constructed in accordance with principles of the present disclosure can be used in a manufacturing process to effectively distribute a multi-phase slurry, such as one containing air and liquid phases, such as found in an aqueous foamed gypsum slurry, for example.

Embodiments of a distribution system constructed in accordance with principles of the present disclosure can be used to distribute a slurry (e.g., an aqueous calcined gypsum slurry) onto an advancing web (e.g., paper or mat) moving on a conveyor during a continuous board (e.g., wallboard) manufacturing process. In one aspect, a slurry distribution system constructed in accordance with principles of the present disclosure can be used in a conventional gypsum drywall manufacturing process as, or part of, a discharge conduit attached to a mixer adapted to agitate calcined gypsum and water to form an aqueous calcined gypsum slurry.

Embodiments of a slurry distribution system constructed in accordance with principles of the present disclosure are aimed at accomplishing wider distribution (along the cross-machine direction) of a uniform gypsum slurry. A slurry distribution system of the present disclosure is suitable for use with a gypsum slurry having a range of WSRs, including WSRs conventionally used to manufacture gypsum wallboard and those that are relatively lower and have a relatively higher viscosity. Furthermore, a gypsum slurry distribution system of the present disclosure can be used to help control air-liquid slurry phase separation, such as, in aqueous foamed gypsum slurry, including foamed gypsum slurry having a very high foam volume. The spreading of the aqueous calcined gypsum slurry over the advancing web can be controlled by routing and distributing the slurry using a distribution system as shown and described herein.

Embodiments of a method of preparing a gypsum product in accordance with principles of the present disclosure can include distributing an aqueous calcined gypsum slurry upon an advancing web using a slurry distributor constructed in accordance with principles of the present disclosure. Various embodiments of a method of distributing an aqueous calcined gypsum slurry upon a moving web are described herein.

Figure 1:
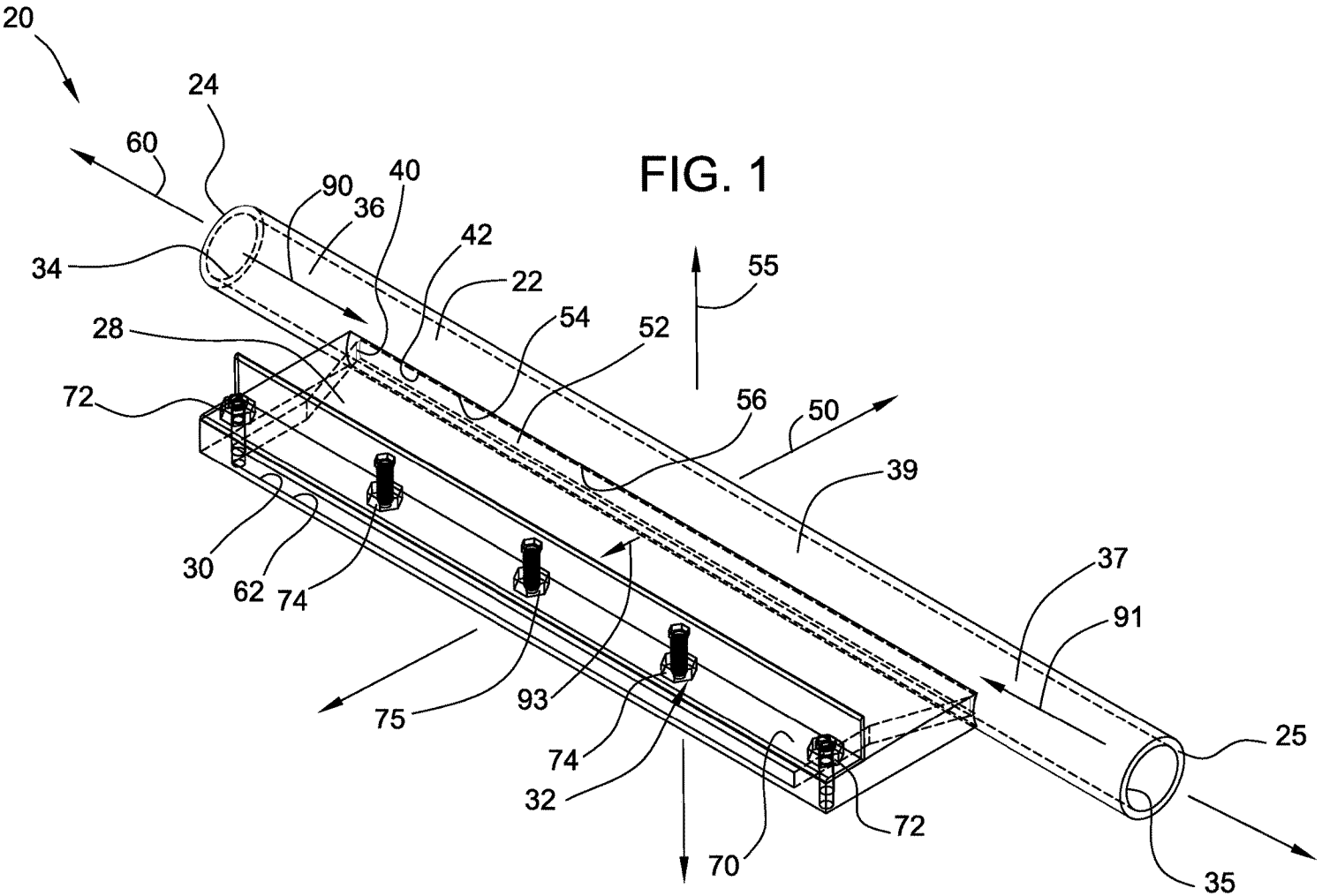
FIG. 1 is a perspective view of an embodiment of a slurry distributor in accordance with principles of the present disclosure.

Turning now to the Figures, there is shown in FIG. 1 an embodiment of a slurry distributor 20 according to principles of the present disclosure. The slurry distributor 20 includes a feed conduit 22, which includes a pair of feed inlets 24, 25, a distribution conduit 28, which is in fluid communication with the feed inlets 24, 25 of the feed conduit and which includes a distribution outlet 30, and a profiling system 32, which is adapted to locally vary the size and/or shape of the distribution outlet 30 of the distribution conduit 28.

The feed conduit 22 extends substantially along a transverse axis or cross-machine direction 60, which is substantially perpendicular to a longitudinal axis or machine direction 50. The first feed inlet 24 is in spaced relationship with the second feed inlet 25. The first feed inlet 24 and the second feed inlet 25 define openings 34, 35 that have substantially the same area. The illustrated openings 34, 35 of the first and second feed inlets 24, 25 both have a circular cross-sectional shape as illustrated in this example. In other embodiments, the cross-sectional shape of the feed inlets 24, 25 can take other forms, depending upon the intended applications and process conditions present. The first and second feed inlets 24, 25 are in opposing relationship to each other along the transverse axis or cross-machine direction 60 with the cross-sectional planes defined by the openings 34, 35 being substantially perpendicular to the transverse axis 60.

The feed conduit 22 includes first and second entry segments 36, 37 and an intermediate connector segment 39. The first and second entry segments 36, 37 are generally cylindrical and extend along the transverse axis 60. The first and second feed inlets 24, 25 are disposed at the distal ends of the first and the second entry segments 36, 37, respectively, and are in fluid communication therewith.

The connector segment 39 is generally cylindrical and is in fluid communication with both the first and the second entry segments 36, 37. The connector segment 39 defines a feed outlet 40 in fluid communication with the first and second feed inlets 24, 25 and the distribution conduit 28. The feed outlet 40 is adapted to receive a first flow in a first feed direction 90 and a second flow in a second flow direction 91 of aqueous calcined gypsum slurry from the first and second feed inlets 24, 25, respectively, and to direct the first and second flows 90, 91 of aqueous calcined gypsum slurry into the distribution conduit 28. The feed outlet 40 is disposed intermediately between the first feed inlet 24 and the second feed inlet 25. The illustrated feed outlet 40 defines a generally rectangular opening 42 that follows the curvature of the illustrated substantially cylindrical feed conduit 22.

The distribution conduit 28 extends generally along the longitudinal axis 50 and includes an entry portion 52 and the distribution outlet 30. The entry portion 52 is in fluid communication with the feed outlet 40 of the feed conduit 22, and thus the first and the second feed inlets 24, 25, as well. The entry portion 52 is adapted to receive both the first and the second flows 90, 91 of aqueous calcined gypsum slurry from the feed outlet 40 of the feed conduit 22. The entry portion 52 of the distribution conduit 28 includes a distribution inlet 54 in fluid communication with the feed outlet 40 of the feed conduit 22. The illustrated distribution 54 inlet defines an opening 56 that substantially corresponds to the opening 42 of the feed outlet 40.

The distribution outlet 30 is in fluid communication with the entry portion 52 and thus the feed outlet 40 and both the first and second feed inlets 24, 25. The illustrated distribution outlet 30 defines a generally rectangular opening 62. The distribution outlet 30 has a width that extends a predetermined distance along the transverse axis 60 and a height that extends a predetermined distance along a vertical axis 55, which is mutually perpendicular to the longitudinal axis 50 and the transverse axis 60. The distribution outlet opening 62 has an area which is smaller than the area of the opening 56 of the distribution inlet 54 (see FIGS. 1-3), but greater than the sum of the areas of the openings 34, 35 of the first and second feed inlets 24, 25.

The slurry distributor is adapted such that the combined first and second flows 90, 91 of aqueous calcined gypsum slurry move through the entry portion 52 from the distribution inlet 54 generally along a distribution direction 93 toward the distribution outlet opening 62. The illustrated distribution direction 93 is substantially along the longitudinal axis 50.

The profiling system 32 includes a plate 70, a plurality of mounting bolts 72 securing the plate to the distribution conduit 28 adjacent the distribution outlet 30, and a series of adjustment bolts 74, 75 threadingly secured thereto. The mounting bolts 72 are used to secure the plate 70 to the distribution conduit 28 adjacent the distribution outlet 30. The plate 70 extends substantially along the transverse axis 60 over the width of the distribution outlet 30. In the illustrated embodiment, the plate 70 is in the form of a length of angle iron. In other embodiments, the plate 70 can have different shapes and can comprise different materials. In still other embodiments, the profiling system 32 can include other and/or additional components.

The portion of the distribution conduit 28 defining the distribution outlet 30 is made from a resiliently flexible material such that its shape is adapted to be variable along its width in the transverse cross-machine direction 60, such as by the adjustment bolts 74, 75, for example. The adjustment bolts 74, 75 are in regular, spaced relationship to each other along the transverse axis 60 over the width of the distribution outlet 30. The adjustment bolts 74, 75 are threadedly engaged with the plate 70. The adjustment bolts 74, 75 are independently adjustable to locally vary the size and/or shape of the distribution outlet 30.

Figure 2:
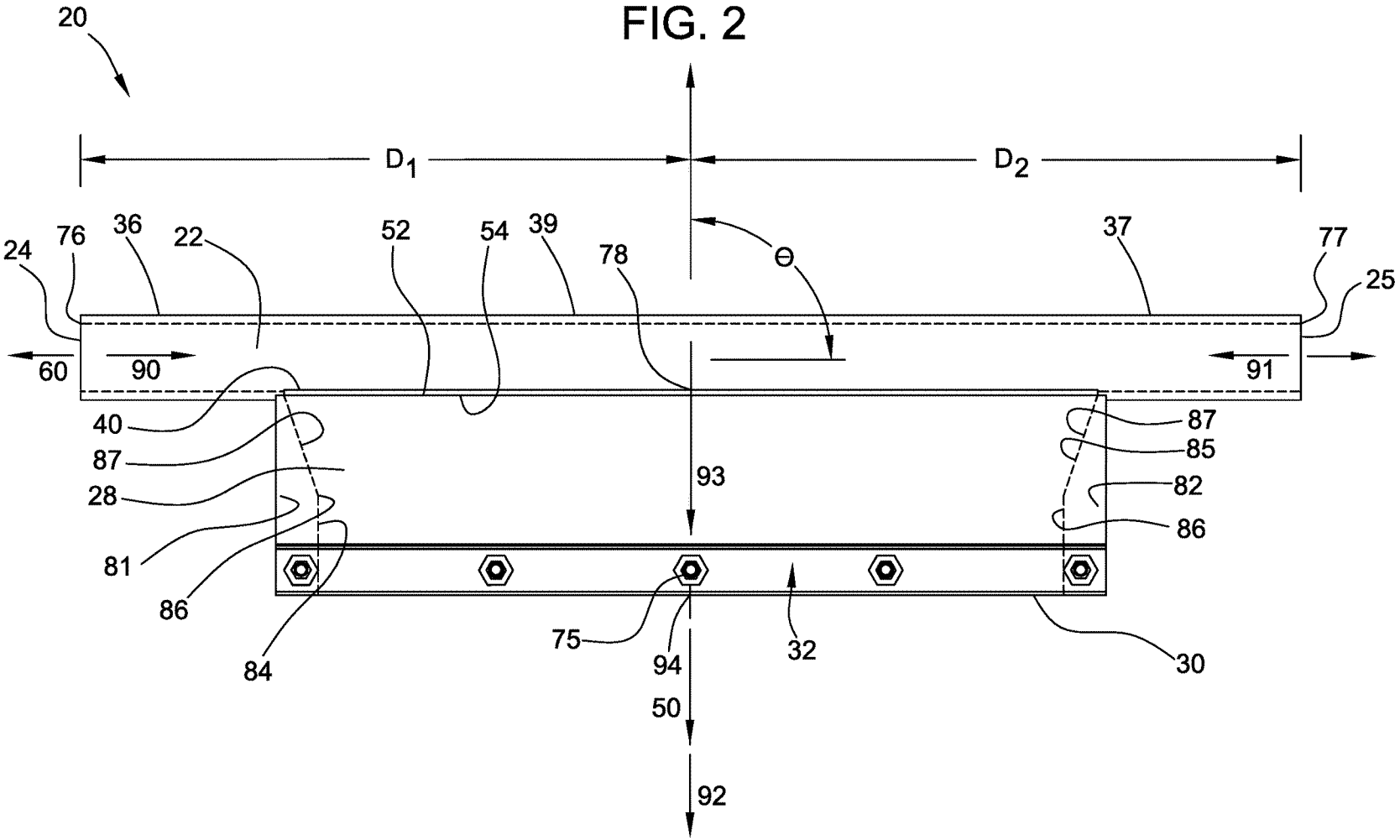
FIG. 2 is a top plan view of the slurry distributor of FIG. 1.

Referring to FIG. 2, the feed conduit 22 extends substantially along the transverse axis 60. The first and second feed inlets 24, 25 are disposed at distal ends 76, 77 of the feed conduit 22. The feed outlet 40 extends substantially along the transverse axis 60 and includes a central midpoint 78 along the transverse axis 60. The feed outlet 40 is disposed intermediately between the first feed inlet 24 and the second feed inlet 25. To help produce substantially the same flow of slurry through the first and second feed inlets 24, 25, the feed outlet 40 can be disposed intermediately between the first feed inlet 24 and the second feed inlet 25 such that the first feed inlet 24 is disposed a first distance $D_1$ from the central midpoint 78 of the feed outlet 40 and the second feed inlet 25 is disposed a second distance $D_2$ from the central midpoint 78 of the feed outlet 40, wherein the first distance $D_1$ and the second distance $D_2$ are substantially equivalent. In other embodiments, the first distance $D_1$ can be different than the second distance $D_2$.

The first and second feed inlets 24, 25 and the first and second entry segments 36, 37 are disposed at a feed angle θ with respect to the longitudinal axis or machine direction 50. In the illustrated embodiment, the feed angle is about 90°. In other embodiments the first and second feed inlets 24, 25 can be oriented in a different manner with respect to the machine direction 50.

A pair of insert blocks 81, 82 can be provided within the distribution conduit 28 to define a pair of sidewalls 84, 85. Each sidewall 84, 85 can include a longitudinal portion 86 that is substantially parallel to the longitudinal axis 50 and a tapered portion 87. The longitudinal portions 86 of the sidewalls 84, 85 are disposed adjacent the distribution outlet 30. The tapered portions 87 of the sidewalls 84, 85 are disposed adjacent the entry portion 52 and converge transversely inwardly in a direction from the distribution inlet 54 toward the distribution outlet 30. The shape of the sidewalls 84, 85 can be configured to promote the flow of the combined flows 90, 91 of aqueous calcined gypsum slurry from the first and second feed inlets 24, 25 past the surfaces of the sidewalls 84, 85.

In some embodiments, the insert blocks 81, 82 can be adapted so that they are removably secured within the distribution conduit 28 to be interchangeable with at least one other pair of insert blocks having a different shape to thereby define a different internal shape for the distribution conduit 28. In other embodiments, the shape of the sidewalls 84, 85 can be varied to inhibit flow separation therefrom such that the edges of a combined flow of aqueous calcined gypsum slurry from the first and second feed inlets 24, 25 flows past the surfaces of the sidewalls 84, 85. In other embodiments, the sidewalls 84, 85 can be defined by other structural members.

In use, a first flow of aqueous calcined gypsum slurry passes through the first feed inlet 24 moving in the first feed direction 90, and a second flow of aqueous calcined gypsum slurry passes through the second feed inlet 25 moving in the second feed direction 91. The illustrated first feed direction 90 and the second feed direction 91 are in opposing relationship to each other and are both substantially parallel to the transverse axis 60. The distribution conduit 28 can be positioned such that it extends along the longitudinal axis 50 which substantially coincides with a machine direction 92 along which a web of cover sheet material moves. The longitudinal axis 50 is substantially perpendicular to the transverse axis 60 and the first and second feed directions 90, 91. The first and second flows 90, 91 of aqueous calcined gypsum slurry combine in the slurry distributor 20 such that the combined first and second flows 90, 91 of aqueous calcined gypsum slurry pass through the distribution outlet 30 in the distribution direction 93 generally along the longitudinal axis 50 and in the direction of the machine direction 92.

The profiling system 32 can be adapted to locally vary the size and/or shape of the distribution outlet 30 so as to alter the flow pattern of the combined first and second flows 90, 91 of aqueous calcined gypsum slurry being distributed from the slurry distributor 20. For example, the mid-line adjustment bolt 75 can be tightened down to constrict the transverse central midpoint 94 of the distribution outlet 30 to increase the edge flow angle in the cross-machine direction 60 in both directions away from the longitudinal axis 50 to facilitate spreading as well as to improve the slurry flow uniformity in the cross-machine direction 60.

Figure 3:
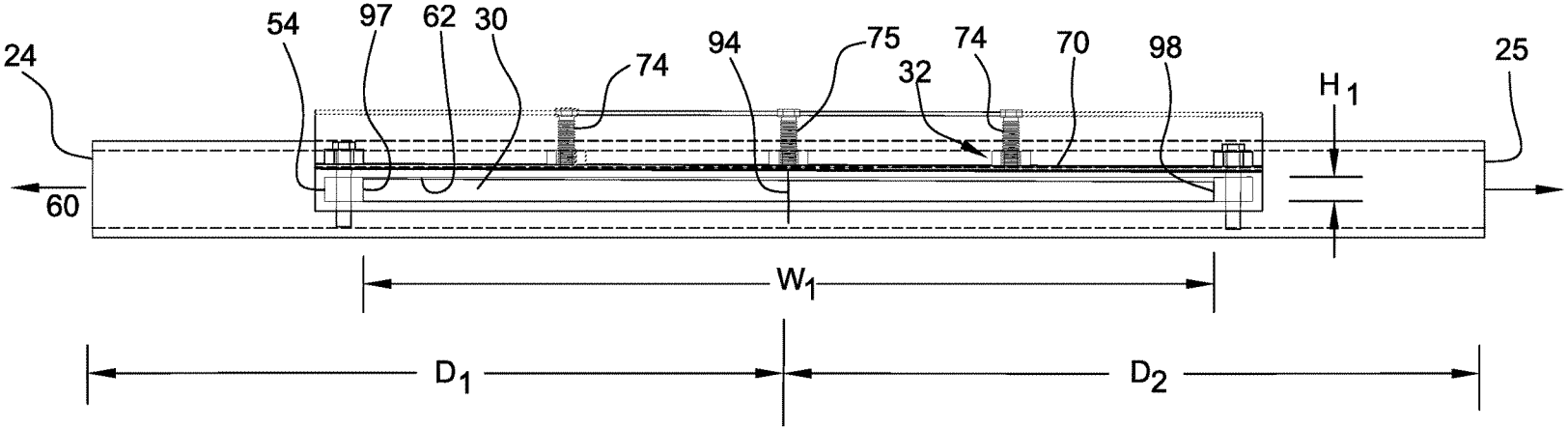
FIG. 3 is a front elevational view of the slurry distributor of FIG. 1.

Referring to FIG. 3, the opening 62 of the distribution outlet 30 is generally rectangular. The illustrated distribution outlet 30 has a width $W_1$ of twenty-four inches and a height $H_1$ of one inch. This rectangular area has been modeled for use on a manufacturing line advancing a moving cover sheet with a nominal operating line speed of 350 feet per minute (fpm). In other embodiments, a distribution outlet having a different size and/or shape can be used on a manufacturing line with a nominal operating speed of 350 fpm. In still other embodiments, the size and/or shape of the opening of the distribution outlet can be varied to yield desired results on a given line based on its particular operating characteristics or be varied for use on manufacturing lines with different line speeds and operating parameters.

The distribution outlet 30 extends substantially along the transverse axis 60. The distribution outlet 30 is narrower along the transverse axis 60 than the distribution inlet 54. The distribution outlet 30 is disposed intermediately between the first feed inlet 24 and the second feed inlet 25 such that the first feed inlet 24 and the second feed inlet 25 are disposed substantially the same distance $D_1$, $D_2$ from the transverse central midpoint 94 of the distribution outlet 30. The distribution outlet 30 is made from a resiliently flexible material such that its shape and/or size is adapted to be variable along the transverse axis 60, such as by the adjustment bolts 74, 75, for example.

The profiling system 32 can be used to vary the shape and/or size of the distribution outlet 30 along the transverse axis 60 and maintain the distribution outlet 30 in the new shape. The plate 70 can be made from a material that is suitably strong such that the plate 70 can withstand opposing forces exerted by the adjustment bolts 74, 75 in response to adjustments made by the adjustment bolts 74, 75 in urging the distribution outlet 30 into a new shape. The profiling system 32 can be used to help even out variations in the flow profile of the slurry (for example, as a result of different slurry densities and/or different feed inlet velocities) being discharged from the distribution outlet 30 such that the exit pattern of the slurry from the distribution conduit 28 is more uniform.

In other embodiments, the number of adjustment bolts can be varied such that the spacing between adjacent adjustment bolts changes. In other embodiments where the width of the distribution outlet 30 is different, the number of adjustment bolts can also be varied to achieve a desired adjacent bolt spacing. In yet other embodiments, the spacing between adjacent bolts can vary along the transverse axis 60, for example to provide greater locally-varying control at the side edges 97, 98 of the distribution outlet 30.

Figure 4:
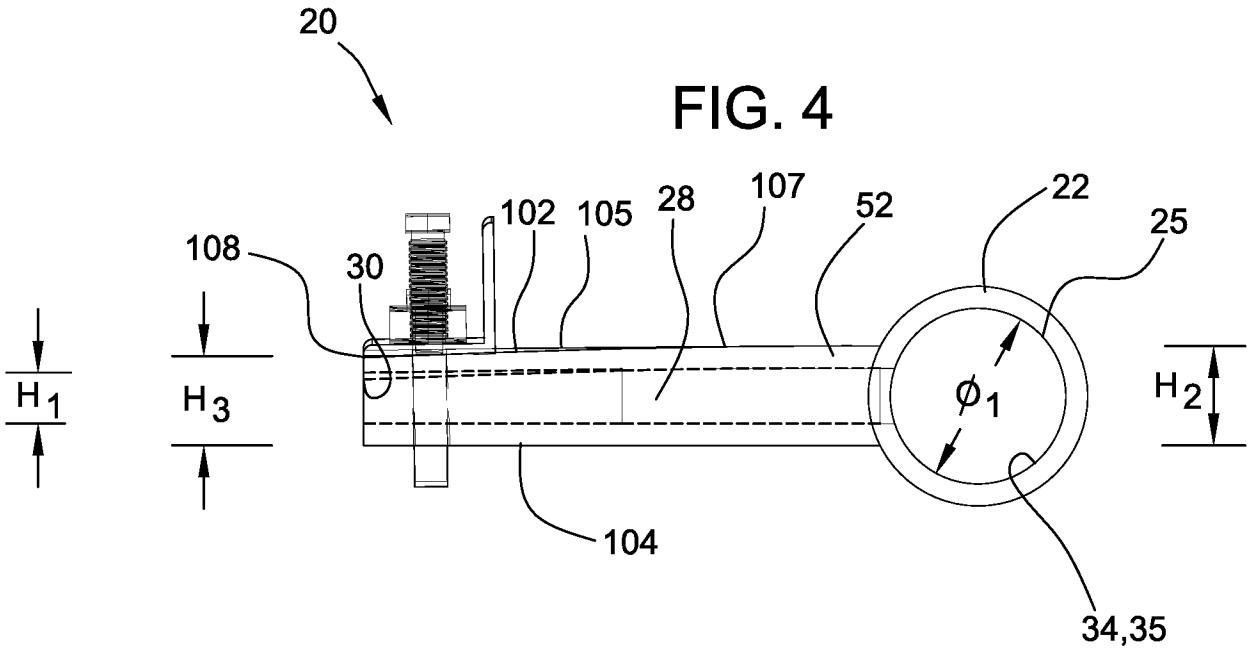
FIG. 4 is a left side elevational view of the slurry distributor of FIG. 1.

Referring to FIG. 4, the distribution conduit 28 includes a converging portion 102 in fluid communication with the entry portion 52. The converging portion 102 can have a height that is smaller than a height in an adjacent region effective to increase a local shear applied to a flow of aqueous calcined gypsum slurry passing through the converging portion 102 relative to a local shear applied in the adjacent region. The converging portion 102 includes a bottom surface 104 and a top surface 105. The top surface 105 is in inclined, spaced relationship with the bottom surface 104 such that the top surface 105 is disposed a first height $H_2$ from the bottom surface 104 at a first edge 107 of the top surface 105 adjacent the entry portion 52 and a second height $H_3$ from the bottom surface 104 at a second edge 108 of the top surface 105 adjacent the distribution outlet 30. The first height $H_2$ is greater than the second height $H_3$ (see FIG. 5 also).

The converging portion 102 and the height $H_1$ of the distribution outlet 30 can cooperate together to help accelerate the average velocity of the combined flows of aqueous calcined gypsum being distributed from the distribution conduit 28 for improved flow stability. The height and/or width of the distribution outlet 30 can be varied to adjust the average velocity of the distributing slurry.

The illustrated feed conduit 22 is a hollow, generally cylindrical pipe. The openings 34, 35 of the illustrated feed inlets have a diameter $Ø_1$ of about three inches for use with a nominal line speed of 350 fpm. In other embodiments, the size of the openings 34, 35 of the feed inlets can be varied. As a general principle, it is contemplated that the size of the openings 34, 35 of the feed inlets can change as a function of nominal line speed.

Figure 5:
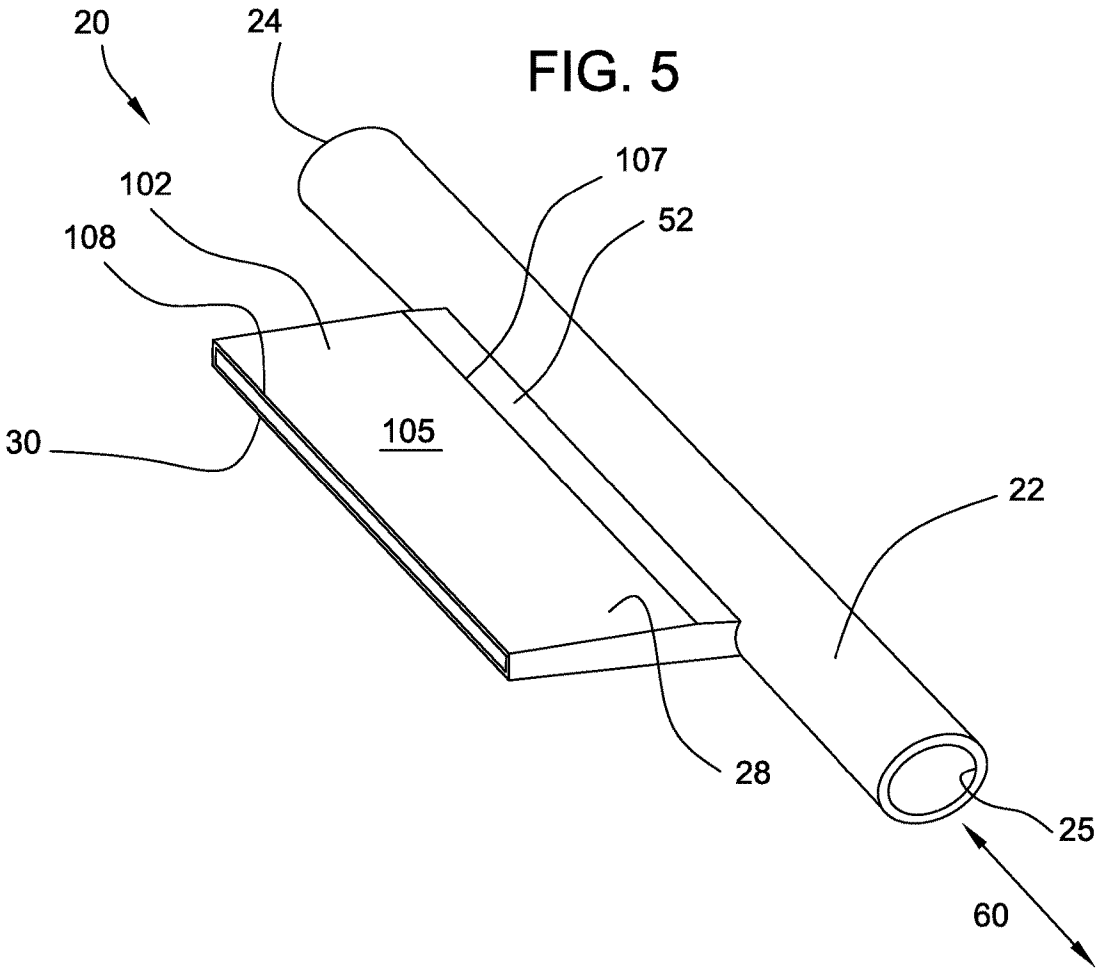
FIG. 5 is a perspective view of the slurry distributor of FIG. 1 with a profiling system removed therefrom.

Referring to FIG. 5, the slurry distributor 20 is shown with the profiling system removed therefrom. In other embodiments, the feed conduit 22 can have other shapes and the feed inlets 24, 25 can have different cross-sectional shapes. In still other embodiments, the feed conduit 22 can have a cross-sectional shape that varies along its length over the transverse axis 60. Similarly, in other embodiments, the distribution conduit 28 and/or the distribution outlet 30 can have different shapes.

The feed conduit 22 and distribution conduit 28 can comprise any suitable material. In some embodiments, the feed conduit 22 and the distribution conduit 28 can comprise any suitable substantially rigid material. For example, a suitably rigid plastic or metal can be used for the feed conduit 22, and a suitable resiliently flexible material can be used for the feed conduit 22.

It is contemplated that the width and/or height of the opening of the distribution outlet can be varied in other embodiments for different operating conditions. In general, the overall dimensions of the various embodiments for slurry distributors as disclosed herein can be scaled up or down depending on the type of product being manufactured, for example, the thickness and/or width of manufactured product, the speed of the manufacturing line being used, the rate of deposition of the slurry through the distributor, the viscosity of the slurry, and the like. For example, the width, along the transverse axis, of the distribution outlet for use in a wallboard manufacturing process, which conventionally is provided in nominal widths no greater than fifty-four inches, can be within a range from about eight to about fifty-four inches in some embodiments, and in other embodiments within a range from about eighteen inches to about thirty inches. The height of the distribution outlet can be within a range from about 3/16 inch to about two inches in some embodiments, and in other embodiments between about 3/16 inch and about an inch. In some embodiments including a rectangular distribution outlet, the ratio of the rectangular width to the rectangular height of the outlet opening can be about 4 or more, in other embodiments about 8 or more, in some embodiments from about 4 to about 288, in other embodiments from about 9 to about 288, in other embodiments from about 18 to about 288, and in still other embodiments from about 18 to about 160.

A slurry distributor constructed in accordance with principles of the present disclosure can comprise any suitable material. In some embodiments, a slurry distributor can comprise any suitable substantially rigid material which can include a suitable material which can allow the size and shape of the outlet to be modified using a profile system, for example. For example, a suitably rigid plastic, such as ultra-high molecular weight (UHMW) plastic or metal can be used. In other embodiments, a slurry distributor constructed in accordance with principles of the present disclosure can be made from a flexible material, such as a suitable flexible plastic material, including poly vinyl chloride (PVC) or urethane, for example.

Any suitable technique for making a slurry distributor constructed in accordance with principles of the present disclosure can be used. For example, in embodiments where the slurry distributor is made from a flexible material, such as PVC or urethane, a multi-piece mold can be used. The exterior surface of the multi-piece mold can define the internal flow geometry of the slurry distributor. The multi-piece mold can be made from any suitable material, such as aluminum, for example. The mold can be dipped in a heated solution of flexible material, such as PVC or urethane. The mold can then be removed from the dipped material.

By making the mold out of multiple separate aluminum pieces that have been designed to fit together to provide the desired geometries, the mold pieces can be disengaged from each other and pulled out from the solution while it is still warm. At sufficiently-high temperatures, the flexible material is pliable enough to pull larger mold pieces through smaller areas of the molded slurry distributor without tearing it. In some embodiments, the mold piece areas are about 115%, and in other embodiments about 110%, or less than the area of the molded slurry distributor through which the mold piece is being pulled during removal. Connecting bolts can be placed to interlock and align the mold pieces so flashing at the joints is reduced and so the bolts can be removed to disassemble the multi-piece mold during removal of the mold from the interior of the molded slurry distributor.

In accordance with another aspect of the present disclosure, a gypsum slurry mixing and dispensing assembly can include a slurry distributor constructed in accordance with principles of the present disclosure. The slurry distributor can be placed in fluid communication with a gypsum slurry mixer adapted to agitate water and calcined gypsum to form an aqueous calcined gypsum slurry. In one embodiment, the slurry distributor is adapted to receive a first flow and a second flow of aqueous calcined gypsum slurry from the gypsum slurry mixer and distribute the first and second flows of aqueous calcined gypsum slurry onto an advancing web.

A gypsum slurry distributor constructed according to principles of the present disclosure can be used to help provide a wide cross machine distribution of aqueous calcined gypsum slurry to facilitate the spreading of high viscous/lower WSR gypsum slurries on a web of cover sheet material moving over a forming table. The gypsum slurry distribution system can be used to help inhibit air-liquid slurry phase separation, as well.

The slurry distributor can comprise a part of, or act as, a discharge conduit of a conventional gypsum slurry mixer (e.g., a pin mixer) as is known in the art. The slurry distributor can be used with components of a conventional discharge conduit. For example, the slurry distributor can be used with components of a gate-canister-boot arrangement as known in the art or of the discharge conduit arrangements described in U.S. Pat. Nos. 6,494,609; 6,874,930; 7,007,914; and/or 7,296,919.

A slurry distributor constructed in accordance with principles of the present disclosure can advantageously be configured as a retrofit in an existing wallboard manufacturing system. The slurry distributor preferably can be used to replace a conventional single or multiple-branch boot used in conventional discharge conduits. This gypsum slurry distributor can be retrofitted to an existing slurry discharge conduit arrangement, such as that shown in U.S. Pat. No. 6,874,930 or 7,007,914, for example, as a replacement for the distal dispensing spout or boot. However, in some embodiments, the slurry distributor may, alternatively, be attached to one or more boot outlet(s).

Figure 6:
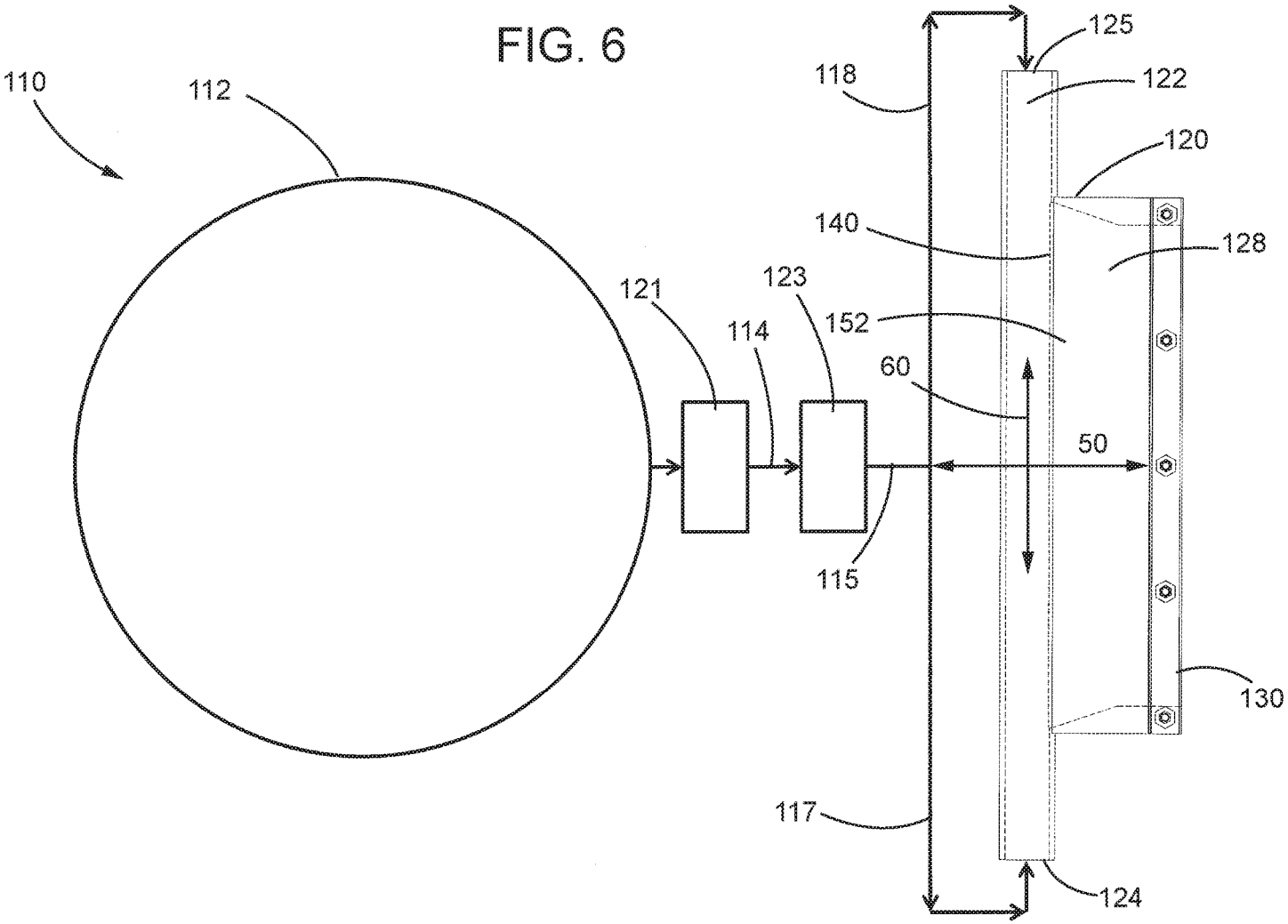
FIG. 6 is a schematic plan diagram of an embodiment of a gypsum slurry mixing and dispensing assembly including a slurry distributor in accordance with principles of the present disclosure.

Referring to FIG. 6, an embodiment of a gypsum slurry mixing and dispensing assembly 110 includes a gypsum slurry mixer 112 in fluid communication with a slurry distributor 120. The gypsum slurry mixer 112 is adapted to agitate water and calcined gypsum to form an aqueous calcined gypsum slurry. Both the water and the calcined gypsum can be supplied to the mixer 112 via one or more inlets as is known in the art. Any suitable mixer can be used with the slurry distributor.

The slurry distributor 120 is in fluid communication with the gypsum slurry mixer 112. The slurry distributor 120 includes a first feed inlet 124 adapted to receive a first flow of aqueous calcined gypsum slurry from the gypsum slurry mixer 112, a second feed inlet 125 adapted to receive a second flow of aqueous calcined gypsum slurry from the gypsum slurry mixer 112, and a distribution outlet 130 in fluid communication with both the first and the second feed inlets 124, 125 and adapted such that the first and second flows of aqueous calcined gypsum slurry discharge from the slurry distributor 120 through the distribution outlet 130.

The slurry distributor 120 includes a feed conduit 122 in fluid communication with a distribution conduit 128. The feed conduit extends generally along a transverse axis 60 and includes the first feed inlet 124, the second feed inlet 125 disposed in spaced relationship to the first feed inlet 124, and a feed outlet 140 in fluid communication with the first feed inlet 124 and the second feed inlet 125. The distribution conduit 128 extends generally along a longitudinal axis 50, which is substantially perpendicular to the longitudinal axis 60, and includes an entry portion 152 and the distribution outlet 130. The entry portion 152 is in fluid communication with the feed outlet 140 of the feed conduit 122 such that the entry portion 152 is adapted to receive both the first and the second flows of aqueous calcined gypsum slurry from the feed outlet 140 of the feed conduit 122. The distribution outlet 130 is in fluid communication with the entry portion 152. The distribution outlet 130 of the distribution conduit 128 extends a predetermined distance along the transverse axis 60. The slurry distributor 120 can be similar in other respects to the slurry distributor of FIG. 1.

A delivery conduit 114 is disposed between and in fluid communication with the gypsum slurry mixer 112 and the slurry distributor 120. The delivery conduit 114 includes a main delivery trunk 115, a first delivery branch 117 in fluid communication with the first feed inlet 124 of the slurry distributor 120, and a second delivery branch 118 in fluid communication with the second feed inlet 125 of the slurry distributor 120. The main delivery trunk 115 is in fluid communication with both the first and second delivery branches 117, 118. In other embodiments, the first and second delivery branches 117, 118 can be in independent fluid communication with the gypsum slurry mixer 112.

The delivery conduit 114 can be made from any suitable material and can have different shapes. In some embodiments, the delivery conduit can comprise a flexible conduit.

An aqueous foam supply conduit 121 can be in fluid communication with at least one of the gypsum slurry mixer 112 and the delivery conduit 114. An aqueous foam from a source can be added to the constituent materials through the foam supply conduit 121 at any suitable location downstream of the mixer 112 and/or in the mixer 112 itself to form a foamed gypsum slurry that is provided to the slurry distributor 120. In the illustrated embodiment, the foam supply conduit 121 is disposed downstream of the gypsum slurry mixer 112. In the illustrated embodiment, the aqueous foam supply conduit 121 has a manifold-type arrangement for supplying foam to an injection ring or block associated with the delivery conduit 114 as described in U.S. Pat. No. 6,874,930, for example.

In other embodiments, one or more secondary foam supply conduits can be provided that are in fluid communication with the mixer. In yet other embodiments, the aqueous foam supply conduit(s) can be in fluid communication with the gypsum slurry mixer alone. As will be appreciated by those skilled in the art, the means for introducing aqueous foam into the gypsum slurry in the gypsum slurry mixing and dispensing assembly 110, including its relative location in the assembly, can be varied and/or optimized to provide a uniform dispersion of aqueous foam in the gypsum slurry to produce board that is fit for its intended purpose.

When the foamed gypsum slurry sets and is dried, the foam dispersed in the slurry produces air voids therein which act to lower the overall density of the wallboard. The amount of foam and/or amount of air in the foam can be varied to adjust the dry board density such that the resulting wallboard product is within a desired weight range.

Any suitable foaming agent can be used. Preferably, the aqueous foam is produced in a continuous manner in which a stream of the mix of foaming agent and water is directed to a foam generator, and a stream of the resultant aqueous foam leaves the generator and is directed to and mixed with the calcined gypsum slurry. Some examples of suitable foaming agents are described in U.S. Pat. Nos. 5,683,635 and 5,643,510, for example.

One or more flow-modifying elements 123 can be associated with the delivery conduit 114 and adapted to control the first and the second flows of aqueous calcined gypsum slurry from the gypsum slurry mixer 112. The flow-modifying element(s) 123 can be used to control an operating characteristic of the first and second flows of aqueous calcined gypsum slurry. In the illustrated embodiment of FIG. 6, the flow-modifying element(s) 123 is associated with the main delivery trunk 115. Examples of suitable flow-modifying elements include volume restrictors, pressure reducers, constrictor valves, canisters etc., including those described in U.S. Pat. Nos. 6,494,609; 6,874,930; 7,007,914; and 7,296,919, for example.

Figure 7:
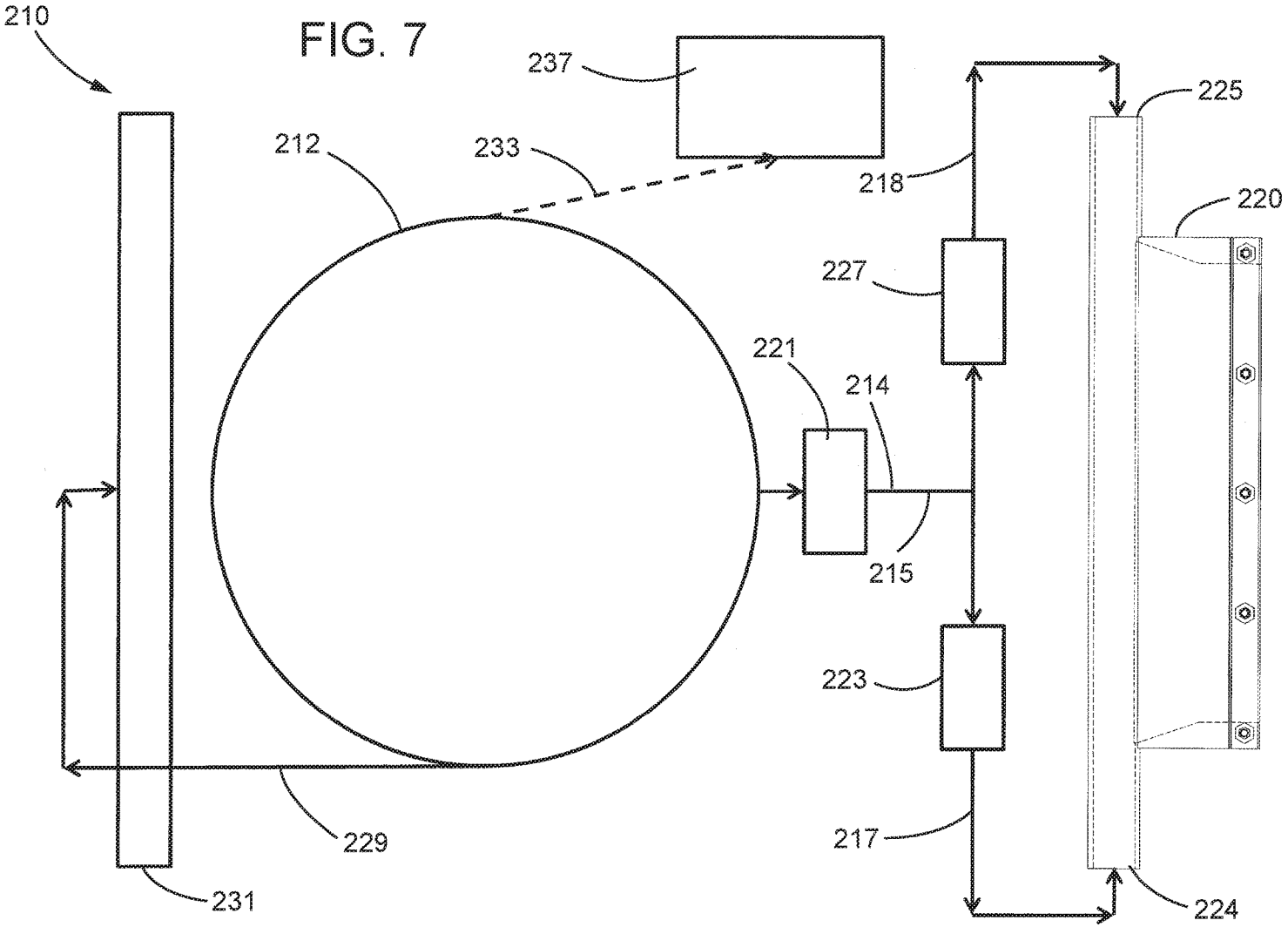
FIG. 7 is a schematic plan diagram of another embodiment of a gypsum slurry mixing and dispensing assembly including a slurry distributor in accordance with principles of the present disclosure.

Referring to FIG. 7, another embodiment of a gypsum slurry mixing and dispensing assembly 210 is shown. The gypsum slurry mixing and dispensing assembly 210 includes a gypsum slurry mixer 212 in fluid communication with a slurry distributor 220. The gypsum slurry mixer 212 is adapted to agitate water and calcined gypsum to form an aqueous calcined gypsum slurry. The slurry distributor 220 can be similar in construction to the slurry distributor 120 of FIG. 1.

A delivery conduit 214 is disposed between and in fluid communication with the gypsum slurry mixer 212 and the slurry distributor 220. The delivery conduit 214 includes a main delivery trunk 215, a first delivery branch 217 in fluid communication with the first feed inlet 224 of the slurry distributor 220, and a second delivery branch 218 in fluid communication with the second feed inlet 225 of the slurry distributor 220.

The main delivery trunk 215 is disposed between and in fluid communication with the gypsum slurry mixer 212 and both the first and the second delivery branches 217, 218. An aqueous foam supply conduit 221 can be in fluid communication with at least one of the gypsum slurry mixer 212 and the delivery conduit 214. In the illustrated embodiment, the aqueous foam supply conduit 221 is associated with the main delivery trunk 215 of the delivery conduit 214.

The first delivery branch 217 is disposed between and in fluid communication with the gypsum slurry mixer 212 and the first feed inlet 224 of the slurry distributor 220. At least one first flow-modifying element 223 is associated with the first delivery branch 217 and is adapted to control the first flow of aqueous calcined gypsum slurry from the gypsum slurry mixer 212.

The second delivery branch 218 is disposed between and in fluid communication with the gypsum slurry mixer 212 and the second feed inlet 225 of the slurry distributor 220. At least one second flow-modifying element 227 is associated with the second delivery branch 218 and is adapted to control the second flow of aqueous calcined gypsum slurry from the gypsum slurry mixer 212.

The first and second flow-modifying elements 223, 227 can be operated to control an operating characteristic of the first and second flows of aqueous calcined gypsum slurry. The first and second flow-modifying elements 223, 227 can be independently operable. In some embodiments, the first and second flow-modifying elements 223, 227 can be actuated to deliver first and second flows of slurries that alternate between a relatively slower and relatively faster average velocity in opposing fashion such that at a given time the first slurry has an average velocity that is faster than that of the second flow of slurry and at another point in time the first slurry has an average velocity that is slower than that of the second flow of slurry.

As one of ordinary skill in the art will appreciate, one or both of the webs of cover sheet material can be pre-treated with a very thin relatively denser layer of gypsum slurry (relative to the gypsum slurry comprising the core), often referred to as a skim coat in the art over the field of the web and/or at least one denser stream of gypsum slurry at the edges of the web to produce if desired. To that end, the mixer 212 includes a first auxiliary conduit 229 that is adapted to deposit a stream of dense aqueous calcined gypsum slurry that is relatively denser than the first and second flows of aqueous calcined gypsum slurry delivered to the slurry distributor (i.e., a "face skim coat/hard edge stream"). The first auxiliary conduit 229 can deposit the face skim coat/hard edge stream upon a moving web of cover sheet material upstream of a skim coat roller 231 that is adapted to apply a skim coat layer to the moving web of cover sheet material and to define hard edges at the periphery of the moving web by virtue of the width of the roller 231 being less than the width of the moving web as is known in the art. Hard edges can be formed from the same dense slurry that forms the thin dense layer by directing portions of the dense slurry around the ends of the roller used to apply the dense layer to the web.

The mixer 212 can also include a second auxiliary conduit 233 adapted to deposit a stream of dense aqueous calcined gypsum slurry that is relatively denser than the first and second flows of aqueous calcined gypsum slurry delivered to the slurry distributor (i.e., a "back skim coat stream"). The second auxiliary conduit 233 can deposit the back skim coat stream upon a second moving web of cover sheet material upstream (in the direction of movement of the second web) of a skim coat roller 237 that is adapted to apply a skim coat layer to the second moving web of cover sheet material as is known in the art (see FIG. 8 also).

In other embodiments, separate auxiliary conduits can be connected to the mixer to deliver one or more separate edge streams to the moving web of cover sheet material. Other suitable equipment (such as auxiliary mixers) can be provided in the auxiliary conduits to help make the slurry therein denser, such as by mechanically breaking up foam in the slurry and/or by chemically breaking down the foam through use of a suitable de-foaming agent.

In yet other embodiments, first and second delivery branches can each include a foam supply conduit therein which are respectively adapted to independently introduce aqueous foam into the first and second flows of aqueous calcined gypsum slurry delivered to the slurry distributor. In still other embodiments, a plurality of mixers can be provided to provide independent streams of slurry to the first and second feed inlets of a slurry distributor constructed in accordance with principles of the present disclosure. It will be appreciated that other embodiments are possible.

Figure 8:
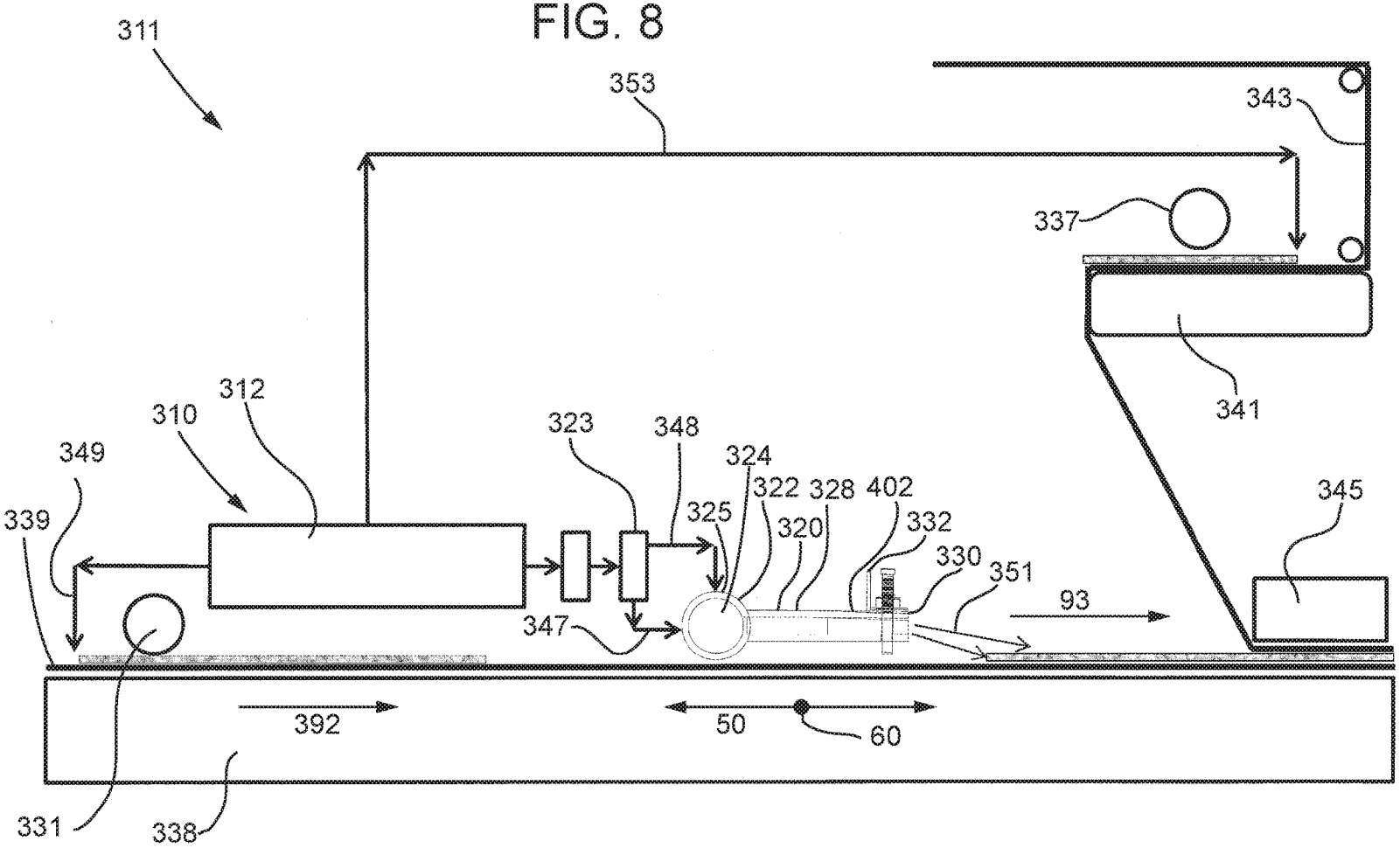
FIG. 8 is a schematic elevational diagram of an embodiment of a wet end of a gypsum wallboard manufacturing line in accordance with principles of the present disclosure.

Referring to FIG. 8, an exemplary embodiment of a wet end 311 of a gypsum wallboard manufacturing line is shown. The wet end 311 includes a gypsum slurry mixing and dispensing assembly 310 including a slurry distributor 320, a hard edge/face skim coat roller 331 disposed upstream of the slurry distributor 320 and supported over a forming table 338 such that a first moving web 339 of cover sheet material is disposed therebetween, a back skim coat roller 337 disposed over a support element 341 such that a second moving web 343 of cover sheet material is disposed therebetween, and a forming station 345 adapted to shape the preform into a desired thickness. The skim coat rollers 331, 337, the forming table 338, the support element 341, and the forming station 345 can all comprise conventional equipment suitable for their intended purposes as is known in the art. The wet end 311 can be equipped with other conventional equipment as is known in the art.

In another aspect of the present disclosure, a slurry distributor constructed in accordance with principles of the present disclosure can be used in a variety of manufacturing processes. For example, in one embodiment, a slurry distribution system can be used in a method of preparing a gypsum product. A slurry distributor can be used to distribute an aqueous calcined gypsum slurry upon the first advancing web 339.

Water and calcined gypsum can be mixed in the mixer 312 to form the first and second flows 347, 348 of aqueous calcined gypsum slurry. In some embodiments, the water and calcined gypsum can be continuously added to the mixer in a water-to-calcined gypsum ratio from about 0.5 to about 1.3, and in other embodiments of about 0.75 or less.

Gypsum board products are typically formed "face down" such that the advancing web 339 serves as the "face" cover sheet of the finished board. A face skim coat/hard edge stream 349 (a layer of denser aqueous calcined gypsum slurry relative to at least one of the first and second flows of aqueous calcined gypsum slurry) can be applied to the first moving web 339 upstream of the hard edge/face skim coat roller 331, relative to the machine direction 392, to apply a skim coat layer to the first web 339 and to define hard edges of the board.

The first flow 347 and the second flow 348 of aqueous calcined gypsum slurry are respectively passed through the first feed inlet 324 and the second feed inlet 325 of the slurry distributor 320. The first feed inlet 324 and the second feed inlet 325 are respectively disposed on opposing sides of the slurry distributor 320. The first and second flows 347, 348 of aqueous calcined gypsum slurry are combined in the slurry distributor 320. The first and second flows 347, 348 of aqueous calcined gypsum slurry move along a flow path through the slurry distributor 320 in the manner of a streamline flow, undergoing minimal or substantially no air-liquid slurry phase separation and substantially without undergoing a vortex flow path.

The first moving web 339 moves along the longitudinal axis 50. The first flow 347 of aqueous calcined gypsum slurry passes through the first feed inlet 324 moving in the first feed direction 90, and the second flow 348 of aqueous calcined gypsum slurry passes through the second feed inlet 325 moving in the second feed direction 91, which is in opposing relationship to the first feed direction 90. The first and the second feed direction 90, 91 are substantially parallel to the transverse axis 60, which is substantially perpendicular to the longitudinal axis 50 (see FIG. 2 also).

The distribution conduit 328 is positioned such that it extends along the longitudinal axis 50 which substantially coincides with the machine direction 392 along which the first web 339 of cover sheet material moves. Preferably, the central midpoint of the distribution outlet 330 (taken along the transverse axis/cross-machine direction) substantially coincides with the central midpoint of the first moving cover sheet 339. The first and second flows 347, 348 of aqueous calcined gypsum slurry combine in the slurry distributor 320 such that the combined first and second flows 351 of aqueous calcined gypsum slurry pass through the distribution outlet 330 in a distribution direction 93 generally along the longitudinal axis 50.

In some embodiments, the distribution conduit 328 is positioned such that it is substantially parallel to the plane defines by the longitudinal axis 50 and the transverse axis 60 of the first web 339 moving along the forming table. In other embodiments, the entry portion of the distribution conduit can be disposed vertically lower or higher than the distribution outlet 330 relative to the first web 339.

The combined first and second flows 351 of aqueous calcined gypsum slurry are discharged from the slurry distributor 320 upon the first moving web 339. The face skim coat/hard edge stream 349 can be deposited from the mixer 312 at a point upstream, relative to the direction of movement of the first moving web 339 in the machine direction 392, of where the first and second flows 347, 348 of aqueous calcined gypsum slurry are discharged from the slurry distributor 320 upon the first moving web 339. The combined first and second flows 347, 348 of aqueous calcined gypsum slurry can be discharged from the slurry distributor with a reduced momentum per unit width along the cross-machine direction relative to a conventional boot design to help prevent "washout" of the face skim coat/hard edge stream 349 deposited on the first moving web 339 (i.e., the situation where a portion of the deposited skim coat layer is displaced from its position upon the moving web 339 in response to the impact of the slurry being deposited upon it).

The first and second flows 347, 348 of aqueous calcined gypsum slurry respectively passed through the first and second feed inlets 324, 325 of the slurry distributor 320 can be selectively controlled with at least one flow-modifying element 323. For example, in some embodiments, the first and second flows 347, 348 of aqueous calcined gypsum slurry are selectively controlled such that the average velocity of the first flow 347 of aqueous calcined gypsum slurry passing through the first feed inlet 324 and the average velocity of the second flow 348 of aqueous calcined gypsum slurry passing through the second feed inlet 325 are varied.

In other embodiments, the average velocity of the first and second flows 347 348 of aqueous calcined gypsum slurry are varied in an alternating, oscillating manner between relatively higher and lower velocities. In this way, at a point in time the average velocity of the first flow 347 of aqueous calcined gypsum slurry passing through the first feed inlet 324 is higher than the average velocity of the second flow 348 of aqueous calcined gypsum slurry passing through the second feed inlet 325, and at another point in time the average velocity of the first flow 347 of aqueous calcined gypsum slurry passing through the first feed inlet 324 is lower than the average velocity of the second flow 348 of aqueous calcined gypsum slurry passing through the second feed inlet 325.

The combined first and second flows 351 of aqueous calcined gypsum slurry are discharged from the slurry distributor 320 through a distribution outlet 320. The distribution outlet 320 has a width extending along the transverse axis 60 and sized such that the ratio of the width of the first moving web 339 of cover sheet material to the width of the distribution outlet 330 is within a range including and between about 1:1 and about 6:1. The ratio of the average velocity of the combined first and second flows 351 of aqueous calcined gypsum slurry discharging from the slurry distributor 320 to the velocity of the moving web 339 of cover sheet material moving along the machine direction 392 can be about 2:1 or less in some embodiments, and from about 1:1 to about 2:1 in other embodiments.

The combined first and second flows 351 of aqueous calcined gypsum slurry discharging from the slurry distributor 320 form a spread pattern upon the moving web 339. At least one of the size and shape of the distribution outlet 330 can be adjusted, which in turn can change the spread pattern.

Thus, slurry is fed into both feed inlets 324, 325 of the feed conduit 322 and then exits through the distribution outlet 330 with an adjustable gap. The converging portion 402 can provide a slight increase in the slurry velocity so as to reduce unwanted exit effects and thereby further improve flow stability at the free surface. Side-to-side flow variation and/or any local variations can be reduced by performing cross-machine (CD) profiling control at the discharge outlet 330 using the profiling system 332. This distribution system can help prevent air-liquid slurry separation in the slurry resulting in a more uniform and consistent material delivered to the forming table 338. In some embodiments, the slurry velocities at the feed inlets 324, 325 of the feed conduit 322 can oscillate periodically between relatively higher and lower average velocities (at one point in time one inlet has a higher velocity than the other inlet, and then at a predetermined point in time vice versa) to help reduce the chance of buildup within the geometry itself.

A back skim coat stream 353 (a layer of denser aqueous calcined gypsum slurry relative to at least one of the first and second flows 347, 348 of aqueous calcined gypsum slurry) can be applied to the second moving web 343. The back skim coat stream 353 can be deposited from the mixer 312 at a point upstream, relative to the direction of movement of the second moving web 343, of the back skim coat roller 337.

Figure 9:
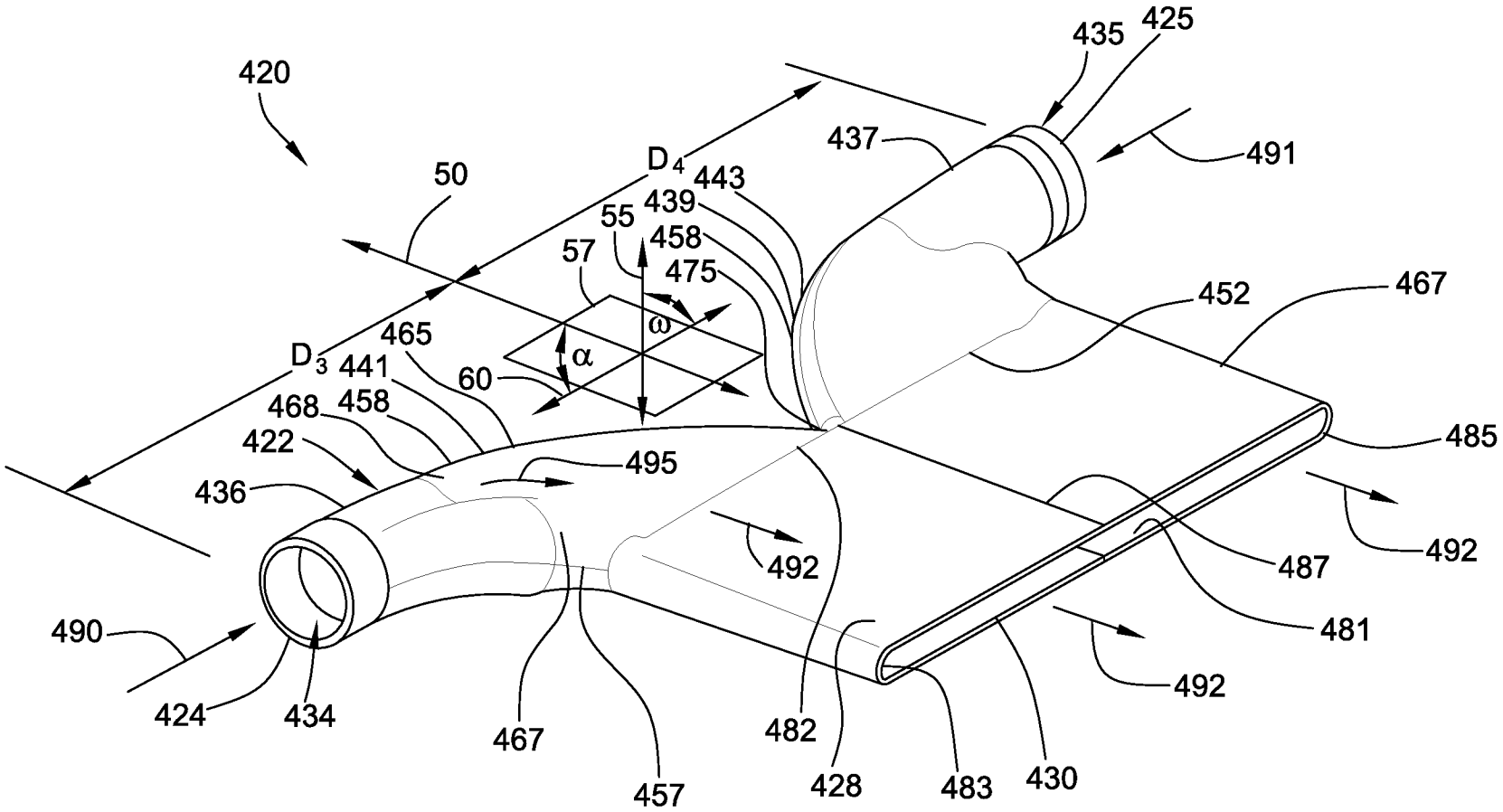
FIG. 9 is a perspective view of another embodiment of a slurry distributor in accordance with principles of the present disclosure.

Referring to FIG. 9, another embodiment of a slurry distributor 420 according to principles of the present disclosure is shown. The interior flow geometry of the slurry distributor 420 shown in FIG. 9 is the same as that shown in FIG. 12, and reference should also be made to FIG. 12 for this embodiment of the slurry distributor 420. The slurry distributor 420 includes a feed conduit 422, which has first and second feed inlets 424, 425, and a distribution conduit 428, which is in fluid communication with the feed conduit 428 and includes a distribution outlet 430. A profiling system 32 (see FIG. 1) adapted to locally vary the size of the distribution outlet 430 of the distribution conduit 428 can also be provided.

The feed conduit 422 extends generally along a transverse axis or cross-machine direction 60, which is substantially perpendicular to a longitudinal axis or machine direction 50. The first feed inlet 424 is in spaced relationship with the second feed inlet 425. The first feed inlet 424 and the second feed inlet 425 define respective openings 434, 435 that have substantially the same area. The first and second feed inlets 424, 425 are in opposing relationship to each other along the transverse axis or cross-machine direction 60 with the cross-sectional planes defined by the openings 434, 435 being substantially perpendicular to the transverse axis 60. The illustrated openings 434, 435 of the first and second feed inlets 424, 425 both have a circular cross-sectional shape. In other embodiments, the cross-sectional shape of the openings 434, 435 of the first and second feed inlets 424, 425 can take other forms, depending upon the intended applications and process conditions present.

The feed conduit 422 includes first and second entry segments 436, 437 and a bifurcated connector segment 439 disposed between the first and second entry segments 436, 437. The first and second entry segments 436, 437 are generally cylindrical and extend along the transverse axis 60 such that they are substantially parallel to a plane 57 defined by the longitudinal axis 50 and the transverse axis 60. The first and second feed inlets 424, 425 are disposed at the distal ends of the first and the second entry segments 436, 437, respectively, and are in fluid communication therewith.

In other embodiments the first and second feed inlets 424, 425 and the first and second entry segments 436, 437 can be oriented in a different manner with respect to the transverse axis 60, the machine direction 50, and/or the plane 57 defined by the longitudinal axis 50 and the transverse axis 60. For example, in some embodiments, the first and second feed inlets 424, 425 and the first and second entry segments 436, 437 can each be disposed substantially in the plane 57 defined by the longitudinal axis 50 and the transverse axis 60 at a feed angle θ with respect to the longitudinal axis or machine direction 50 which is an angle in a range up to about 135° with respect to the machine direction 50, and in other embodiments in a range from about 30° to about 135°, and in yet other embodiments in a range from about 45° to about 135°, and in still other embodiments in a range from about 40° to about 110°.

The bifurcated connector segment 439 is in fluid communication with the first and second feed inlets 424, 425 and the first and the second entry segments 436, 437. The bifurcated connector segment 439 includes first and second shaped ducts 441, 443. The first and second feed inlets 24, 25 of the feed conduit 22 are in fluid communication with the first and second shaped ducts 441, 443, respectively. The first and second shaped ducts 441, 443 of the connector segment 439 are adapted to receive a first flow in a first feed direction 490 and a second flow in a second flow direction 491 of aqueous calcined gypsum slurry from the first and second feed inlets 424, 425, respectively, and to direct the first and second flows 490, 491 of aqueous calcined gypsum slurry into the distribution conduit 428. The first and second shaped ducts 441, 443 of the connector segment 439 define first and second feed outlets 440, 445 respectively in fluid communication with the first and second feed inlets 424, 425. Each feed outlet 440, 445 is in fluid communication with the distribution conduit 428. Each of the illustrated first and second feed outlets 440, 445 defines an opening 442 with a generally rectangular inner portion 447 and a substantially circular side portion 449. The circular side portions 445 are disposed adjacent side walls 451, 453 of the distribution conduit 428.

The connector segment 439 is substantially parallel to the plane 57 defined by the longitudinal axis 50 and the transverse axis 60. In other embodiments the connector segment 439 can be oriented in a different manner with respect to the transverse axis 60, the machine direction 50, and/or the plane 57 defined by the longitudinal axis 50 and the transverse axis 60.

The first feed inlet 424, the first entry segment 436, and the first shaped duct 441 are a mirror image of the second feed inlet 425, the second entry segment 437, and the second shaped duct 443, respectively. Accordingly, it will be understood that the description of one feed inlet is applicable to the other feed inlet, the description of one entry segment is applicable to the other entry segment, and the description of one shaped duct is applicable to the other shaped duct, as well in a corresponding manner.

The first shaped duct 441 is fluidly connected to the first feed inlet 424 and the first entry segment 436. The first shaped duct 441 is also fluidly connected to the distribution conduit 428 to thereby help fluidly connect the first feed inlet 424 and the distribution outlet 430 such that the first flow 490 of slurry can enter the first feed inlet 424; travel through the first entry segment 436, the first shaped duct 441, and the distribution conduit 428; and be discharged from the slurry distributor 420 through the distribution outlet 430.

The first shaped duct 441 has a front, outer curved wall 457 and an opposing rear, inner curved wall 458 defining a curved guide surface 465 adapted to redirect the first flow of slurry from the first feed flow direction 490, which is substantially parallel to the transverse or cross-machine direction 60, to an outlet flow direction 492, which is substantially parallel to the longitudinal axis or machine direction 50 and substantially perpendicular to the first feed flow direction 490. The first shaped duct 441 is adapted to receive the first flow of slurry moving in the first feed flow direction 490 and redirect the slurry flow direction by a change in direction angle α, as shown in FIG. 9, such that the first flow of slurry is conveyed into the distribution conduit 428 moving substantially in the outlet flow direction 492.

In use, the first flow of aqueous calcined gypsum slurry passes through the first feed inlet 424 in the first feed direction 490, and the second flow of aqueous calcined gypsum slurry passes through the second feed inlet 425 in the second feed direction 491. The first and second feed directions 490, 491 can be symmetrical with respect to each other along the longitudinal axis 50 in some embodiments. The first flow of slurry moving in the first feed flow direction 490 is redirected in the slurry distributor 420 through a change in direction angle α in a range up to about 135° to the outlet flow direction 492. The second flow of slurry moving in the second feed flow direction s redirected in the slurry distributor through a change in direction angle α in a range up to about 135° to the outlet flow direction 492. The combined first and second flows 490, 491 of aqueous calcined gypsum slurry discharge from the slurry distributor 420 moving generally in the outlet flow direction 492. The outlet flow direction 492 can be substantially parallel to the longitudinal axis or machine direction 50.

For example, in the illustrated embodiment, the first flow of slurry is redirected from the first feed flow direction 490 along the cross-machine direction 60 through a change in direction angle α of about ninety degrees about the vertical axis 55 to the outlet flow direction 492 along the machine direction 50. In some embodiments, the flow of slurry can be redirected from a first feed flow direction 490 through a change in direction angle α about the vertical axis 55 within a range up to about 135° to the outlet flow direction 492, and in other embodiments in a range from about 30° to about 135°, and in yet other embodiments in a range from about 45° to about 135°, and in still other embodiments in a range from about 40° to about 110°.

In some embodiments, the shape of the rear curved guide surface 465 can be generally parabolic, which in the illustrated embodiment can be defined by a parabola of the form $Ax^2+B$. In alternate embodiments, higher order curves may be used to define the rear curved guide surface 465 or, alternatively, the rear, inner wall 458 can have a generally curved shape that is made up of straight or linear segments that have been oriented at their ends to collectively define a generally curved wall. Moreover, the parameters used to define the specific shape factors of the outer wall can depend on specific operating parameters of the process in which the slurry distributor will be used.

At least one of the feed conduit 422 and the distribution conduit 428 can include an area of expansion having a cross-sectional flow area that is greater than a cross-sectional flow area of an adjacent area upstream from the area of expansion in a direction from the feed conduit 422 toward the distribution conduit 428. The first entry segment 436 and/or the first shaped duct 441 can have a cross section that varies along the direction of flow to help distribute the first flow of slurry moving therethrough. The shaped duct 441 can have a cross sectional flow area that increases in a first flow direction 495 from the first feed inlet 424 toward the distribution conduit 428 such that the first flow of slurry is decelerated as it passes through the first shaped duct 441. In some embodiments, the first shaped duct 441 can have a maximum cross-section flow area at a predetermined point along the first flow direction 495 and decrease from the maximum cross-sectional flow area at points further along the first flow direction 495.

In some embodiments, the maximum cross-sectional flow area of the first shaped duct 441 is about 200% of the cross-sectional area of the opening 434 of the first feed inlet 424 or less. In yet other embodiments, the maximum cross-sectional flow area of the shaped duct 441 is about 150% of the cross-sectional area of the opening 434 of the first feed inlet 424 or less. In still other embodiments, the maximum cross-sectional flow area of the shaped duct 441 is about 125% of the cross-sectional area of the opening 434 of the first feed inlet 424 or less. In yet other embodiments, the maximum cross-sectional flow area of the shaped duct 441 is about 110% of the cross-sectional area of the opening 434 of the first feed inlet 424 or less. In some embodiments, the cross-sectional flow area is controlled such that the flow area does not vary more than a predetermined amount over a given length to help prevent large variations in the flow regime.

In some embodiments, the first entry segment 436 and/or the first shaped duct 441 can include one or more guide channels 467, 468 that are adapted to help distribute the first flow of slurry toward the outer and/or the inner walls 457, 458 of the feed conduit 422. The guide channels 467, 468 are adapted to increase the flow of slurry around the boundary wall layers of the slurry distributor 420. The guide channels 467, 468 can be configured to have a larger cross-sectional area than an adjacent portion 471 of the feed conduit 422 which defines a restriction that promotes flow to the adjacent guide channel 467, 468 respectively disposed at the wall region of the slurry distributor 420. In the illustrated embodiment, the feed conduit 422 includes the outer guide channel 467 adjacent the outer wall 457 and the sidewall 451 of the distribution conduit 428 and the inner guide channel 468 adjacent the inner wall 458 of the first shaped duct 441. The cross-sectional areas of the outer and inner guide channels 467, 468 can become progressively smaller moving in the first flow direction 495. The outer guide channel 467 can extend substantially along the sidewall 451 of the distribution conduit 428 to the distribution outlet 430. At a given cross-sectional location through the first shaped duct 441 in a direction perpendicular to the first flow direction 495, the outer guide channel 467 has a larger cross-sectional area than the inner guide channel 468 to help divert the first flow of slurry from its initial line of movement in the first feed direction 490 toward the outer wall 457.

Providing guide channels adjacent wall regions can help direct or guide slurry flow to those regions, which can be areas in conventional systems where "dead spots" of low slurry flow are found. By encouraging slurry flow at the wall regions of the slurry distributor 420 through the provision of guide channels, slurry buildup inside the slurry distributor is discouraged and the cleanliness of the interior of the slurry distributor 420 can be enhanced. The frequency of slurry buildup breaking off into lumps which can tear the moving web of cover sheet material can also be decreased.

In other embodiments, the relative sizes of the outer and inner guide channels 467, 468 can be varied to help adjust the slurry flow to improve flow stability and reduce the occurrence of air-liquid slurry phase separation. For example, in applications using a slurry that is relatively more viscous, at a given cross-sectional location through the first shaped duct 441 in a direction perpendicular to the first flow direction 495, the outer guide channel 467 can have a smaller cross-sectional area than the inner guide channel 468 to help urge the first flow of slurry toward the inner wall 458.

The inner curved walls 458 of the first and second shaped ducts 441, 442 meet to define a peak 475 adjacent an entry portion 452 of the distribution conduit 428. The peak 475 effectively bifurcates the connector segment 439.

The location of the peak 475 along the longitudinal axis 50 can vary in other embodiments. For example, the inner curved walls 458 of the first and second shaped ducts 441, 442 can be less curved in other embodiments such that the peak 475 is further away from the distribution outlet 430 along the longitudinal axis 50 than as shown in the illustrated slurry distributor 420. In other embodiments, the peak 475 can be closer to the distribution outlet 430 along the longitudinal axis 50 than as shown in the illustrated slurry distributor 420.

The distribution conduit 428 is substantially parallel to the plane 57 defined by the longitudinal axis 50 and the transverse axis 60 and is adapted to urge the combined first and second flows of aqueous calcined gypsum slurry from the first and second shaped ducts 441, 442 into a generally two-dimensional flow pattern for enhanced stability and uniformity. The distribution outlet 430 has a width that extends a predetermined distance along the transverse axis 60 and a height that extends along a vertical axis 55, which is mutually perpendicular to the longitudinal axis 50 and the transverse axis 60. The height of the distribution outlet 430 is small relative to its width. The distribution conduit 428 can be oriented relative to a moving web of cover sheet upon a forming table such that the distribution conduit 428 is substantially parallel to the moving web.

The distribution conduit 428 extends generally along the longitudinal axis 50 and includes the entry portion 452 and the distribution outlet 430. The entry portion 452 is in fluid communication with the first and second feed inlets 424, 425 of the feed conduit 422. The entry portion 452 is adapted to receive both the first and the second flows of aqueous calcined gypsum slurry from the first and second feed inlets 424, 425 of the feed conduit 422. The entry portion 452 of the distribution conduit 428 includes a distribution inlet 454 in fluid communication with the first and second feed outlets 440, 445 of the feed conduit 422. The illustrated distribution 454 inlet defines an opening 456 that substantially corresponds to the openings 442 of the first and second feed outlets 440, 445. The first and second flows of aqueous calcined gypsum slurry combine in the distribution conduit 428 such that they combined flows move generally in the outlet flow direction 492 which can be substantially aligned with the line of movement of a web of cover sheet material moving over a forming table in a wallboard manufacturing line.

The distribution outlet 430 is in fluid communication with the entry portion 452 and thus the first and second feed inlets 424, 425 and the first and second feed outlets 440, 445 of the feed conduit 422. The distribution outlet 430 is in fluid communication with the first and second shaped ducts 441, 443 and is adapted to discharge the combined first and second flows of slurry therefrom along the outlet flow direction 492 upon a web of cover sheet material advancing along the machine direction 50.

The illustrated distribution outlet 430 defines a generally rectangular opening 481 with semi-circular narrow ends 483, 485. The semi-circular ends 483, 485 of the opening 481 of the distribution outlet 430 can be the terminating end of the outer guide channels 467 disposed adjacent the side walls 451, 453 of the distribution conduit 428.

The distribution outlet opening 481 has an area which is smaller than the area of the sum of the distribution inlets 454, 455, but greater than the sum of the areas of the openings 434, 435 of the first and second feed inlets 424, 425. For example, in some embodiments, the cross-sectional area of the opening 481 of the distribution outlet 430 can be in a range from greater than to about 400% greater than the sum of the cross-sectional areas of the openings 434, 435 of the first and second feed inlets 424, 425. In other embodiments, the ratio of the sum of the cross-sectional areas of the openings 434, 435 of the first and second feed inlets 424, 425 to the opening 481 of the distribution outlet 430 can be varied based upon one or more factors, including the speed of the manufacturing line, the viscosity of the slurry being distributed by the distributor 420, the width of the board product being made with the distributor 420, etc.

The distribution outlet 430 extends substantially along the transverse axis 60. The opening 481 of the distribution outlet 430 has a width of about twenty-four inches along the transverse axis 60 and a height of one inch along the vertical axis 55. In other embodiments, the size and shape of the opening of the distribution outlet 430 can be varied.

The distribution outlet 430 is disposed intermediately along the transverse axis 60 between the first feed inlet 424 and the second feed inlet 425 such that the first feed inlet 424 and the second feed inlet 425 are disposed substantially the same distance $D_3$, $D_4$ from a transverse central midpoint 487 of the distribution outlet 430. The distribution outlet 430 is made from a resiliently flexible material such that its shape is adapted to be variable along the transverse axis 60, such as by the profiling system 32, for example.

The distribution conduit 428 includes a converging portion 482 in fluid communication with the entry portion 452. The height of the converging portion 482 is less than the height at the maximum cross-sectional flow area of the first and second shaped ducts 441, 443 and less than the height of the opening 481 of the distribution outlet 430. In some embodiments, the height of the converging portion 482 can be about half the height of the opening 481 of the distribution outlet 430.

The converging portion 482 and the height of the distribution outlet 430 can cooperate together to help control the average velocity of the combined first and second flows of aqueous calcined gypsum being distributed from the distribution conduit 428. The height and/or width of the distribution outlet 430 can be varied to adjust the average velocity of the combined first and second flows of slurry discharging from the slurry distributor 420.

In some embodiments, the outlet flow direction 492 is substantially parallel to the plane 57 defined by the machine direction 50 and the transverse cross-machine direction 60 of the system transporting the advancing web of cover sheet material. In other embodiments, the first and second feed directions 490, 491 and the outlet flow direction 492 are all substantially parallel to the plane 57 defined by the machine direction 50 and the transverse cross-machine direction 60 of the system transporting the advancing web of cover sheet material. In some embodiments, the slurry distributor can be adapted and arranged with respect to the forming table such that the flow of slurry is redirected in the slurry distributor 420 from the first and second feed directions 490, 491 to the outlet flow direction 492 without undergoing substantial flow redirection by rotating about the cross-machine direction 60.

In some embodiments, the slurry distributor can be adapted and arranged with respect to the forming table such that the first and second flows of slurry are redirected in the slurry distributor from the first and second feed directions 490, 491 to the outlet flow direction 492 by redirecting the first and second flows of slurry by rotating about the cross-machine direction 60 over an angle of about forty-five degrees or less. Such a rotation can be accomplished in some embodiments by adapting the slurry distributor such that the first and second feed inlets 424, 425 and the first and second feed directions 490, 491 of the first and second flows of slurry are disposed at a vertical offset angle $\omega$ with respect to the vertical axis 55 and the plane 57 formed by the machine axis 50 and the cross-machine axis 60. In embodiments, the first and second feed inlets 424, 425 and the first and second feed directions 490, 491 of the first and second flows of slurry can be disposed at a vertical offset angle $\omega$ within a range from zero to about sixty degrees such that the flow of slurry is redirected about the machine axis 50 and moves along the vertical axis 55 in the slurry distributor 420 from the first and second feed directions 490, 491 to the outlet flow direction 492. In embodiments, at least one of the respective entry segment 436, 437 and the shaped ducts 441, 443 can be adapted to facilitate the redirection of the slurry about the machine axis 50 and along the vertical axis 55. In embodiments, the first and second flows of slurry can be redirected from the first and second feed directions 490, 491 through a change in direction angle $\alpha$ about an axis substantially perpendicular to vertical offset angle $\omega$ and/or one or more other rotational axes within a range of about forty-five degrees to about one hundred fifty degrees to the outlet flow direction 492 such that the outlet flow direction 492 is generally aligned with the machine direction 50.

In use, first and second flows of aqueous calcined gypsum slurry pass through the first and second feed inlets 424, 425 in converging first and second feed directions 490, 491. The first and second shaped ducts 441, 443 redirect the first and second flows of slurry from the first feed direction 490 and the second feed direction 491 so that the first and second flows of slurry move over a change in direction angle $\alpha$ from both being substantially parallel to the transverse axis 60 to both being substantially parallel to the machine direction 50. The distribution conduit 428 can be positioned such that it extends along the longitudinal axis 50 which substantially coincides with the machine direction 50 along which a web of cover sheet material moves in a method making a gypsum board. The first and second flows of aqueous calcined gypsum slurry combine in the slurry distributor 420 such that the combined first and second flows of aqueous calcined gypsum slurry pass through the distribution outlet 430 in the outlet flow direction 492 generally along the longitudinal axis 50 and in the direction of the machine direction.

The profiling system 32 can be used to locally vary the distribution outlet 430 so as to alter the flow pattern of the combined first and second flows of aqueous calcined gypsum slurry being distributed from the slurry distributor 420. The profiling system 32 can be used to vary the size of the distribution outlet 430 along the transverse axis 60 and maintain the distribution outlet 430 in the new shape.

Figure 10:
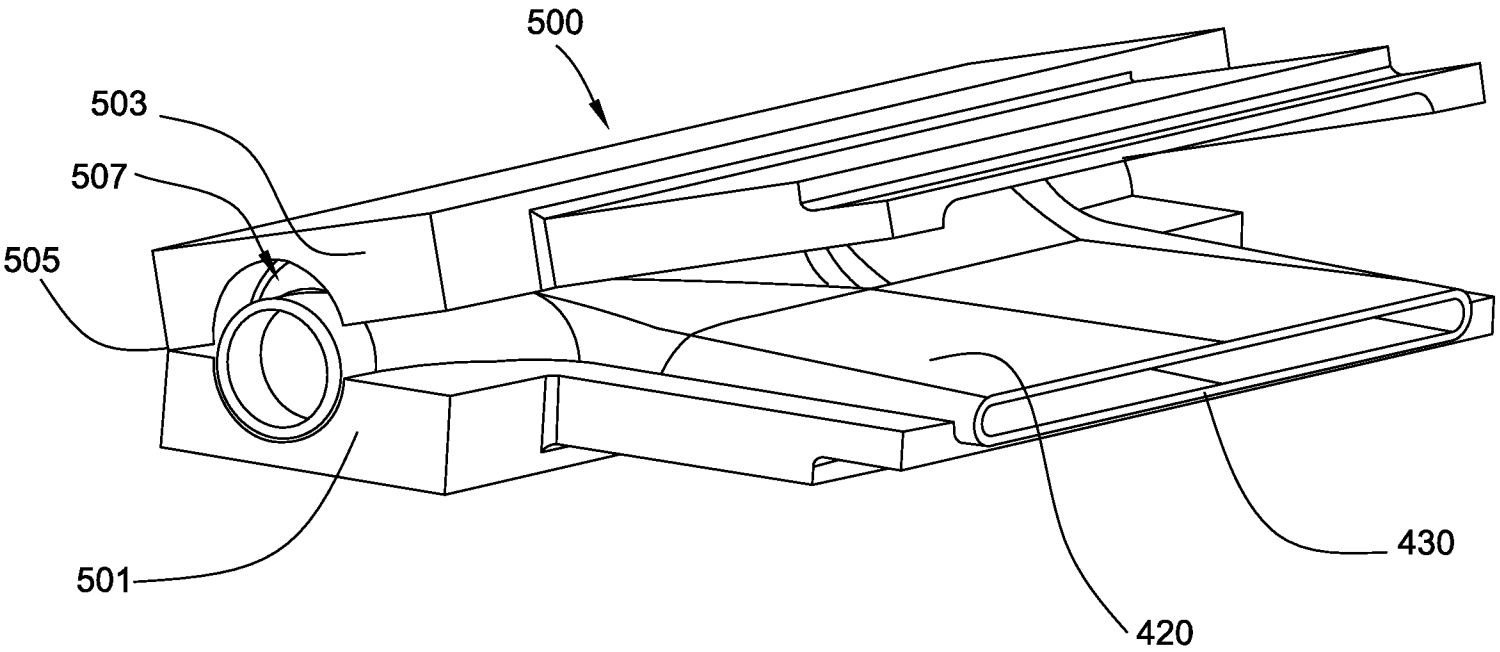
FIG. 10 is a perspective view of an embodiment of a slurry distributor support and the slurry distributor of FIG. 9 housed therein.

Referring to FIG. 10, a slurry distributor support 500 can be provided to help support the slurry distributor 420, which in the illustrated embodiment is made from a flexible material, such as PVC or urethane, for example. The slurry distributor support 500 can be made from a suitable rigid material to help support the flexible slurry distributor 420. The slurry distributor support 500 can include a two-piece construction. The two pieces 501, 503 can be pivotally movable with respect to each other about a hinge 505 at the rear end thereof to allow for ready access to an interior 507 of the support 500. The interior 506 of the support 500 can be configured such that interior 506 substantially conforms to the exterior of the slurry distributor 420 to help limit the amount of movement the slurry distributor 420 can undergo with respect to the support 500.

In some embodiments, the slurry distributor support 500 can be made from a suitable resiliently flexible material that provides support and is able to be deformed in response to a profiling system 32 (see FIG. 1) mounted to the support 500. The profiling system 32 can be mounted to the support adjacent the distribution outlet 430 of the slurry distributor 420. The profiling system 32 so installed can act to locally vary the size and/or shape of the distribution outlet 430 of the distribution conduit 428 by also varying the size and/or shape of the closely conforming support 500.

Figure 11:
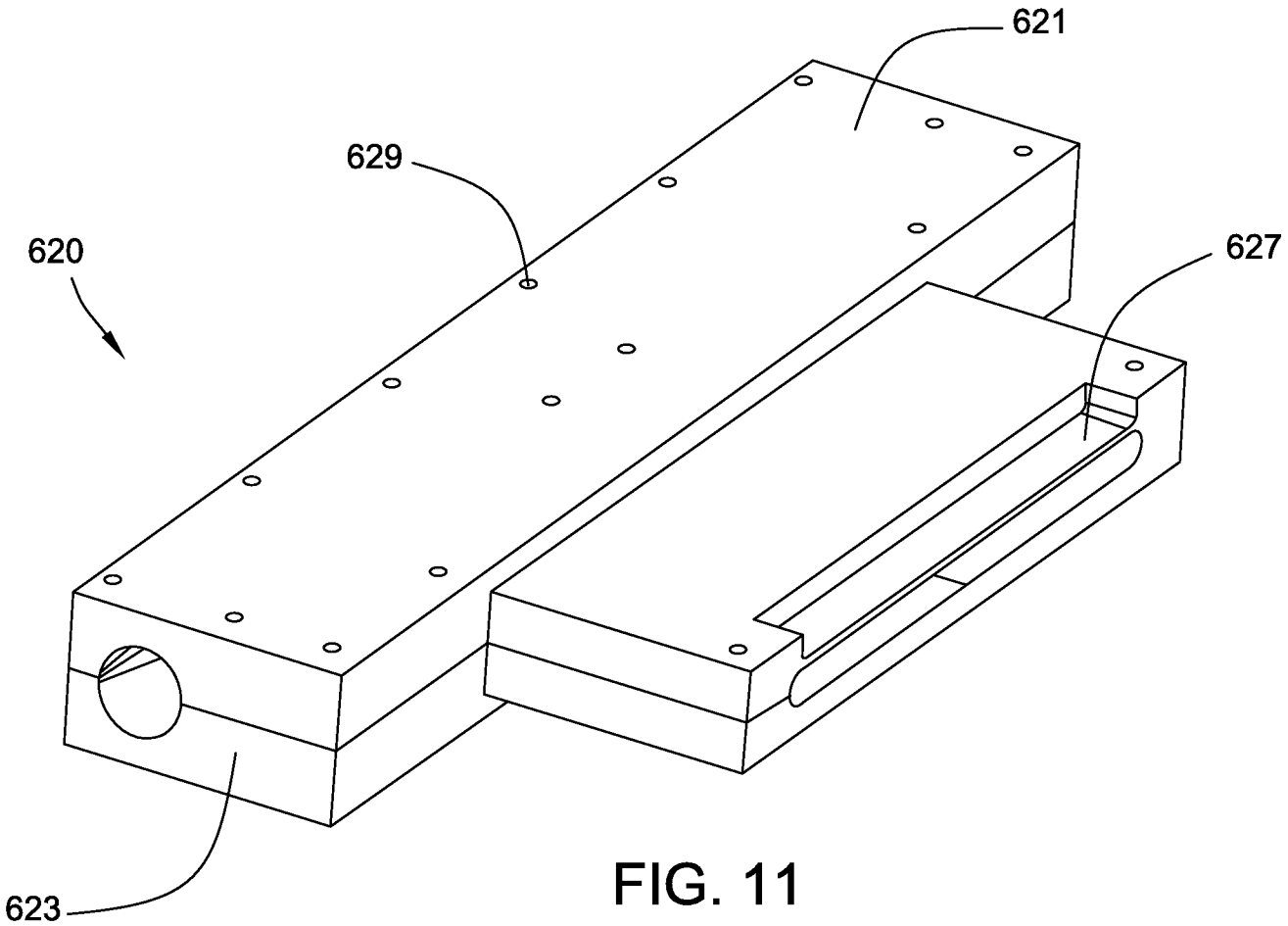
FIG. 11 is a perspective view of another embodiment of a slurry distributor in accordance with principles of the present disclosure.
Figure 12:
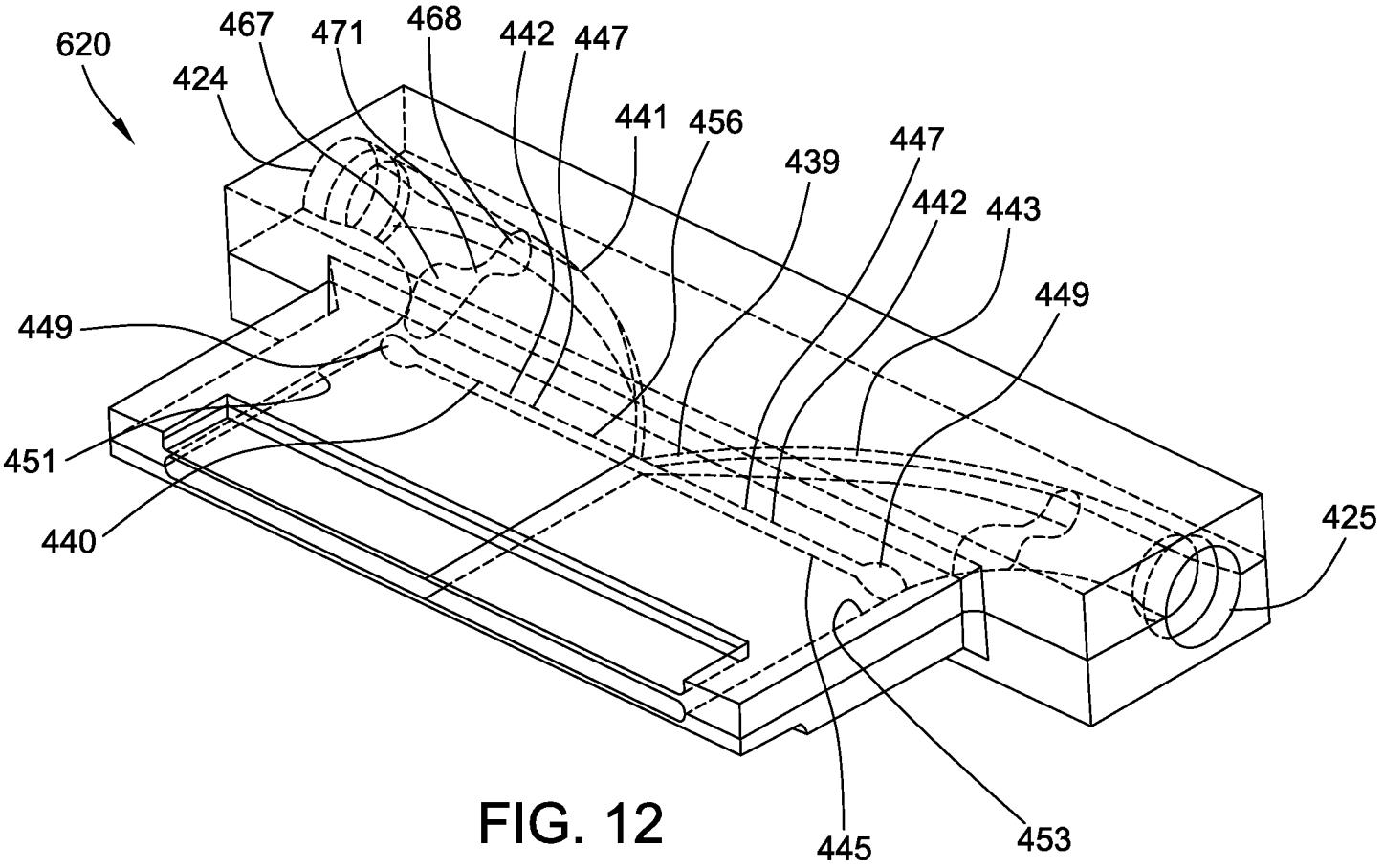
FIG. 12 is another perspective view of the slurry distributor of FIG. 11.

FIGS. 11 and 12 illustrate another embodiment of a slurry distributor 620, which is similar to the slurry distributor 420 of FIG. 9, except that it is constructed from a substantially rigid material. The slurry distributor 620 of FIG. 11 has a two-piece construction. An upper piece 621 of the slurry distributor includes a recess 627 adapted to receive a profiling system 32 therein. Mounting holes 629 are provided to facilitate the connection of the upper piece 621 and its mating lower piece 623. The interior geometry of the slurry distributor 620 of FIG. 11 is similar to that of the slurry distributor 420 of FIG. 9, and like reference numerals are used to indicate like structure.

Figure 13:
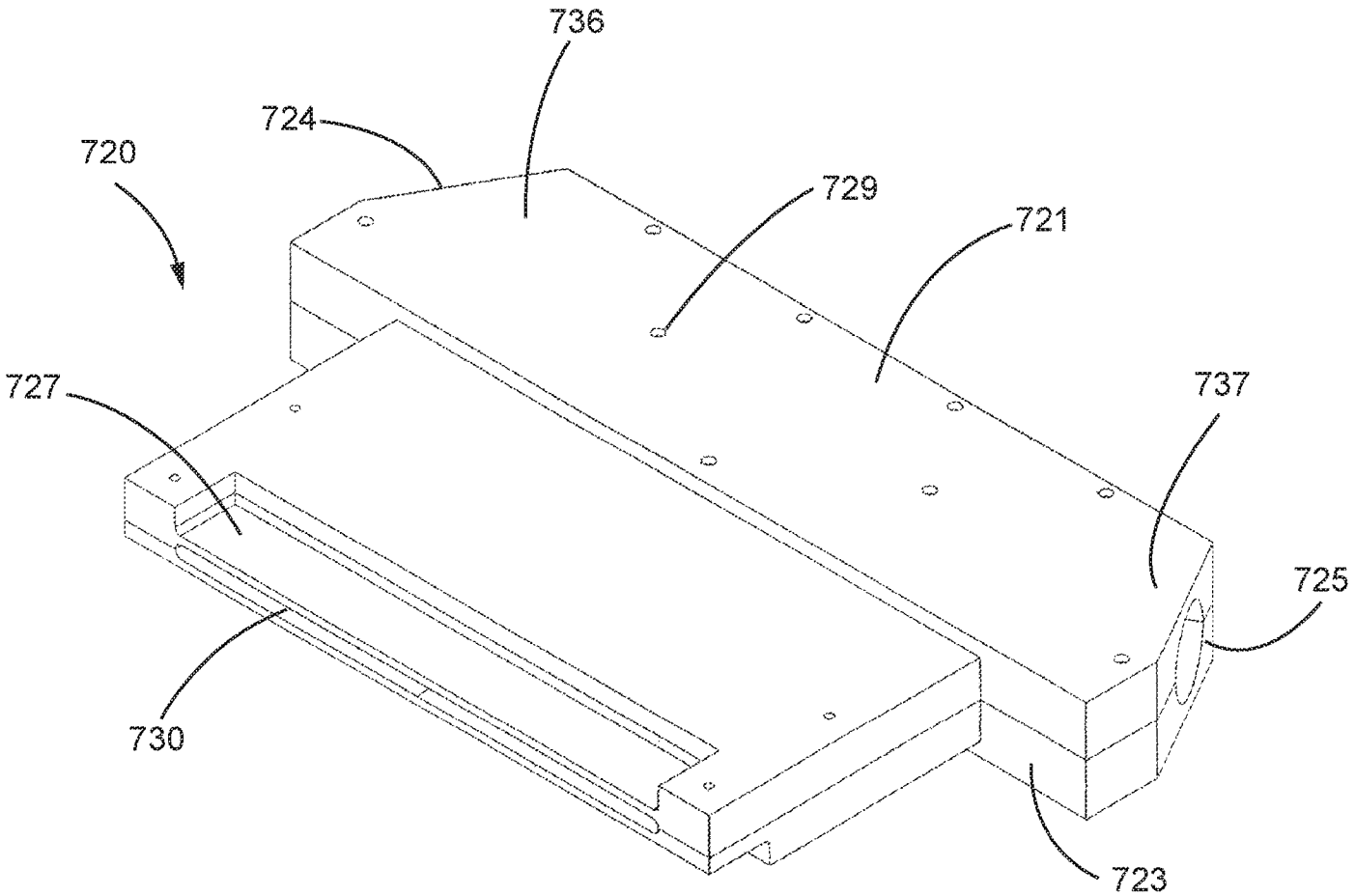
FIG. 13 is a perspective view of another embodiment of a slurry distributor in accordance with principles of the present disclosure.
Figure 14:
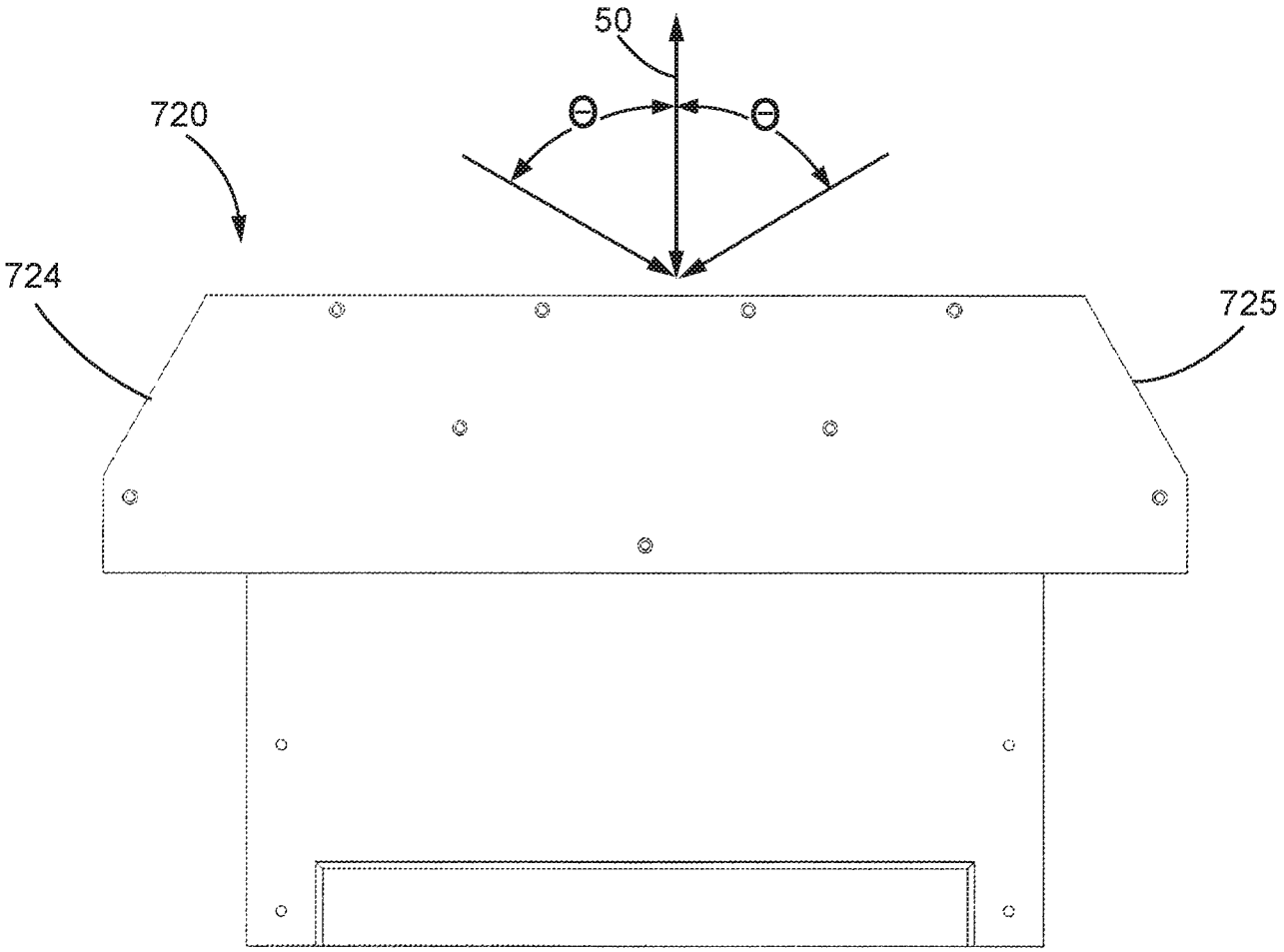
FIG. 14 is a top plan view of the slurry distributor of FIG. 13.
Figure 15:
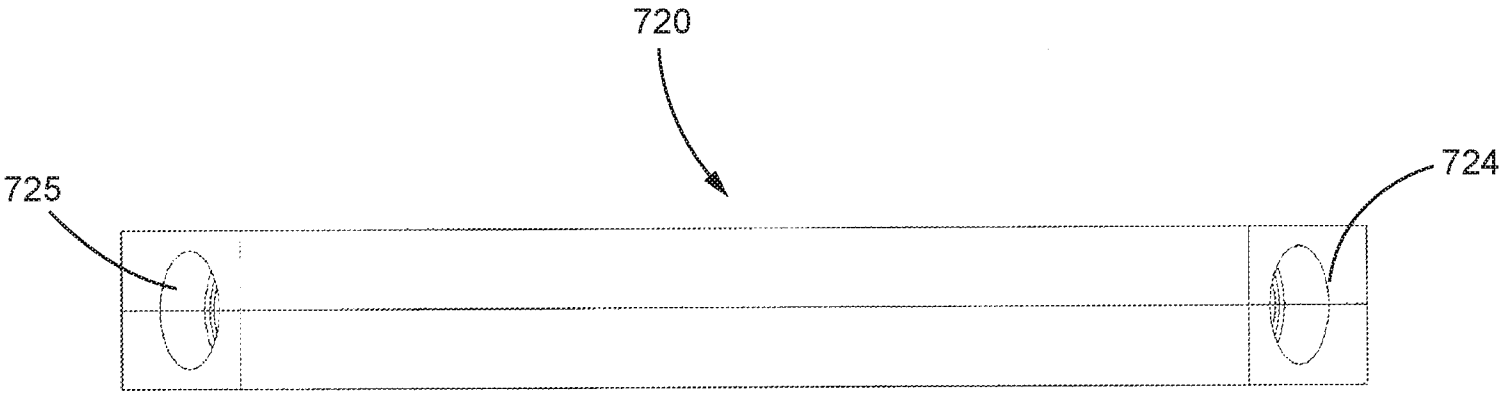
FIG. 15 is a rear elevational view of the slurry distributor of FIG. 13.

Referring to FIGS. 13-15, another embodiment of a slurry distributor 720 constructed in accordance with principles of the present disclosure is shown. The slurry distributor 720 of FIG. 13 is similar to the slurry distributor 420 of FIG. 9 and 620 of FIG. 11 except that the first and second feed inlets 724, 725 and the first and second entry segments 736, 737 of the slurry distributor 720 of FIG. 13 are disposed at a feed angle θ with respect to the longitudinal axis or machine direction 50 of about 60° (see FIG. 14).

The slurry distributor 720 has a two-piece construction including an upper piece 721 and its mating lower piece 723. The two pieces 721, 723 of the slurry distributor 720 can be secured together using any suitable technique, such as by using fasteners through a corresponding number of mounting holes 729 provided in each piece 712, 723, for example. The upper piece 721 of the slurry distributor 720 includes a recess 727 adapted to receive a profiling system 32 therein. The slurry distributor 720 of FIG. 13 is similar in other respects to the slurry distributor 420 of FIG. 9 and the slurry distributor 620 of FIG. 11.

Figure 16:
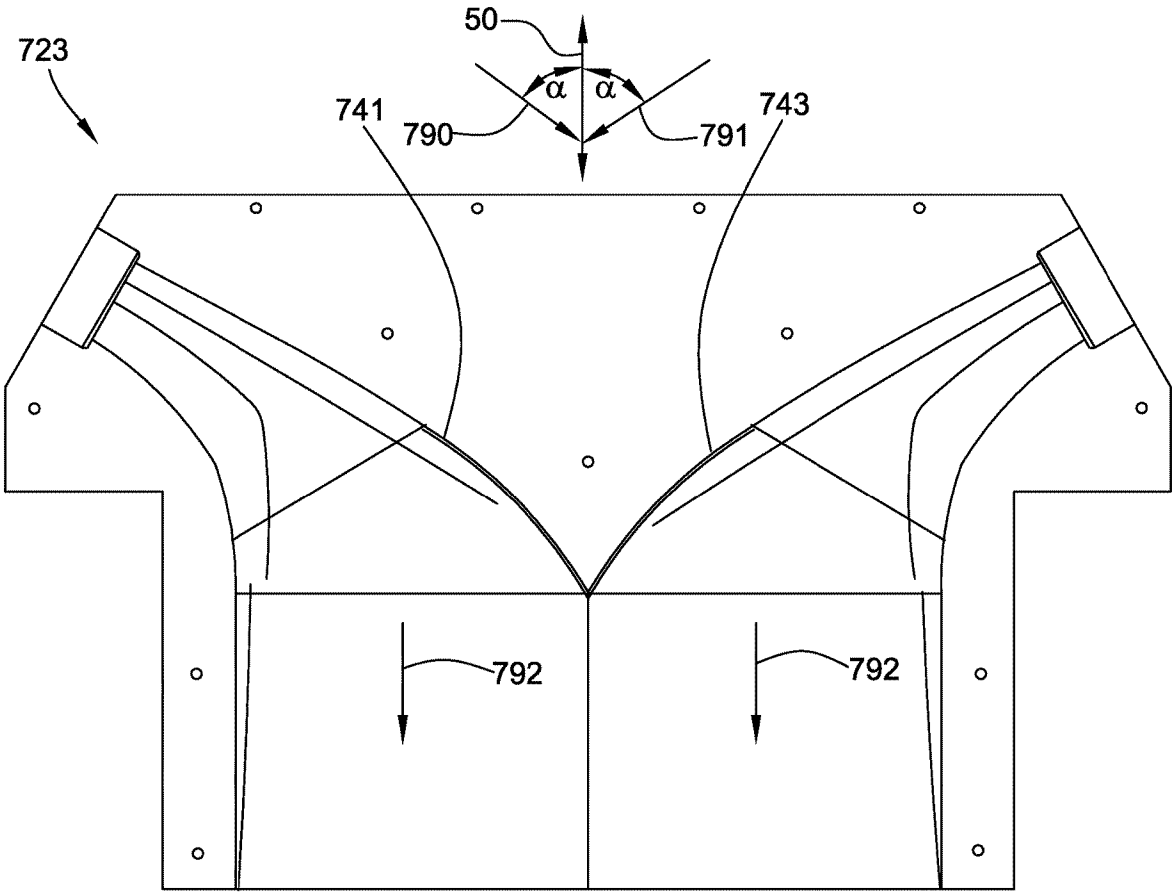
FIG. 16 is a top plan view of a bottom piece of the slurry distributor of FIG. 13.
Figure 17:
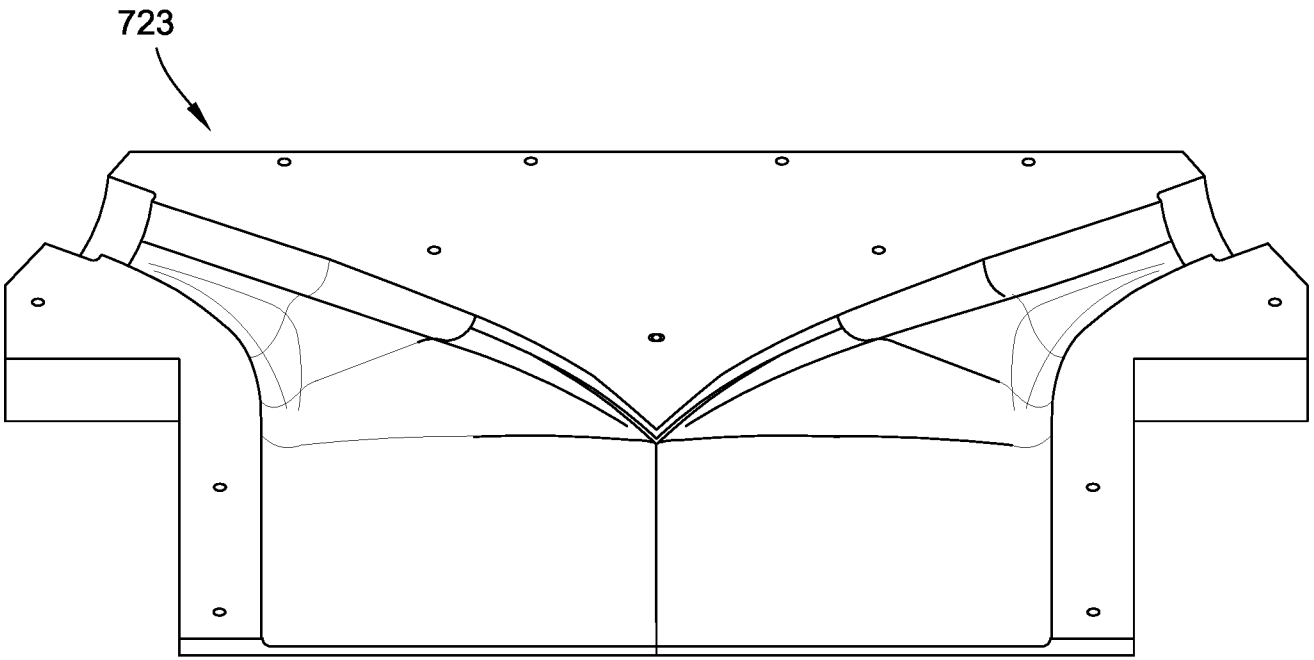
FIG. 17 is a perspective view of the bottom piece of FIG. 16.

Referring to FIGS. 16 and 17, the lower piece 723 of the slurry distributor 720 of FIG. 13 is shown. The lower piece 723 defines a first portion 731 of the interior geometry of the slurry distributor 720 of FIG. 13. The upper piece defines a symmetrical second portion of the interior geometry such that when the upper and lower pieces 721, 723 are mated together, they define the complete interior geometry of the slurry distributor 720 of FIG. 13.

Referring to FIG. 16, the first and second shaped ducts 771,743 are adapted to receive the first and second flows of slurry moving in the first and second feed flow directions 790, 791 and redirect the slurry flow direction by a change in direction angle α such that the first and second flows of slurry are conveyed into the distribution conduit 728 moving substantially in the outlet flow direction 792, which is aligned with the machine direction or longitudinal axis 50.

Figure 18:
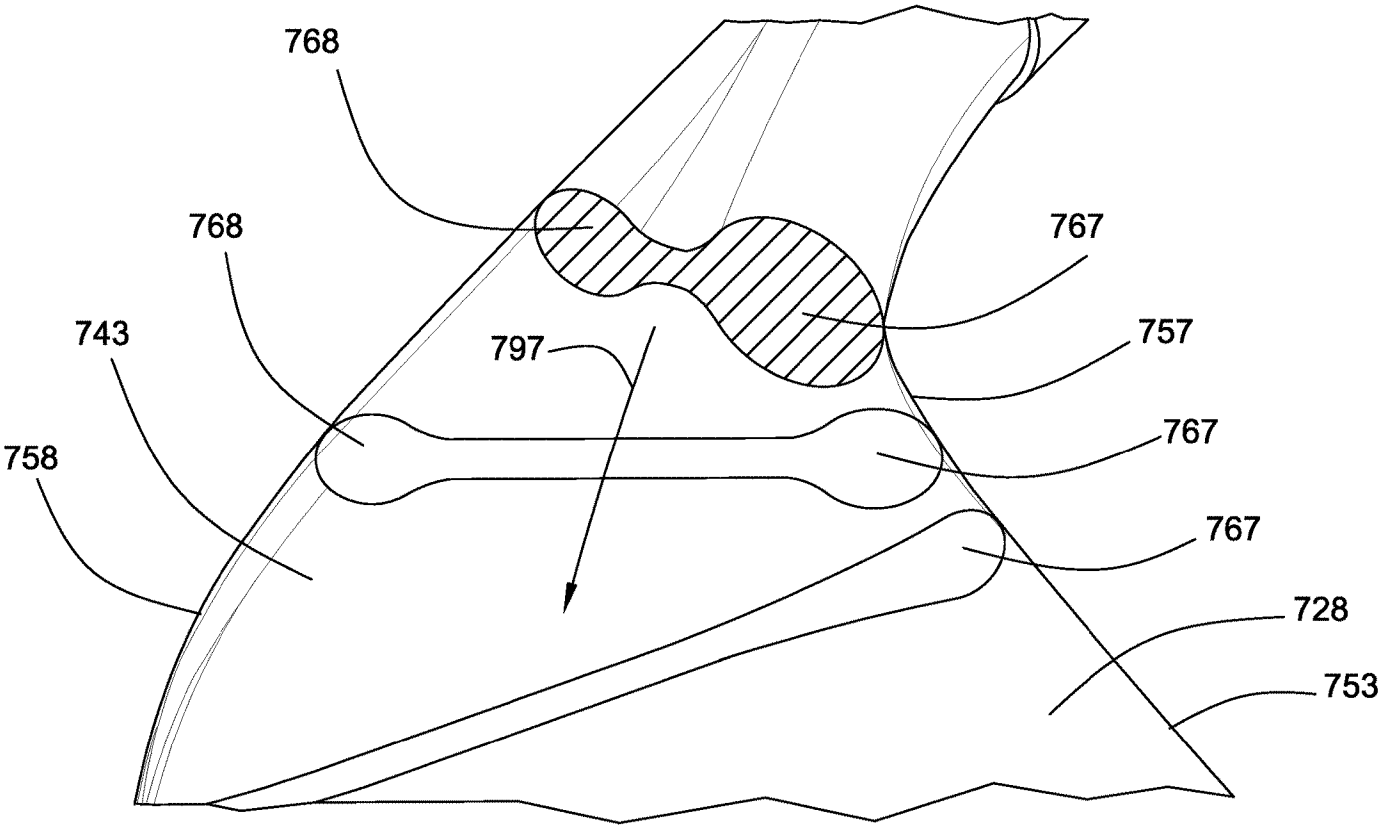
FIG. 18 is a fragmentary, perspective view of the interior geometry of the slurry distributor of FIG. 13.
Figure 19:
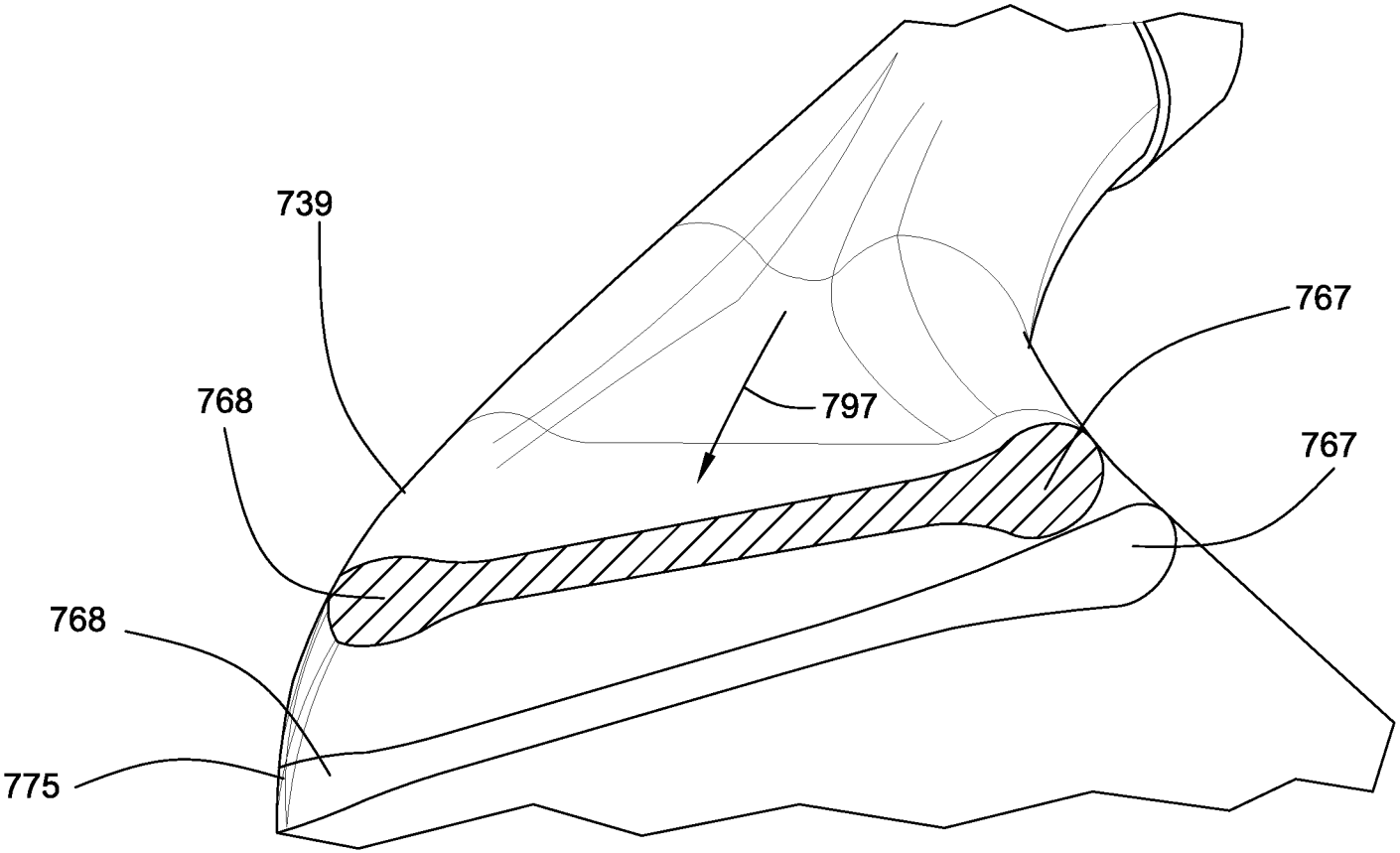
FIG. 19 is another fragmentary, perspective view of the interior geometry of the slurry distributor of FIG. 13.

FIGS. 18 and 19 illustrate how the cross-sectional areas of the outer and inner guide channels 767, 768 can become progressively smaller moving in the second flow direction 797 toward the distribution outlet 730. The outer guide channel 767 can extend substantially along the outer wall 757 of the second shaped duct 743 and along the sidewall 753 of the distribution conduit 728 to the distribution outlet 730. The inner guide channel 768 is adjacent the inner wall 758 of the second shaped duct 743 and terminates at the peak 775 of the bisected connector segment 739.

Figure 20:
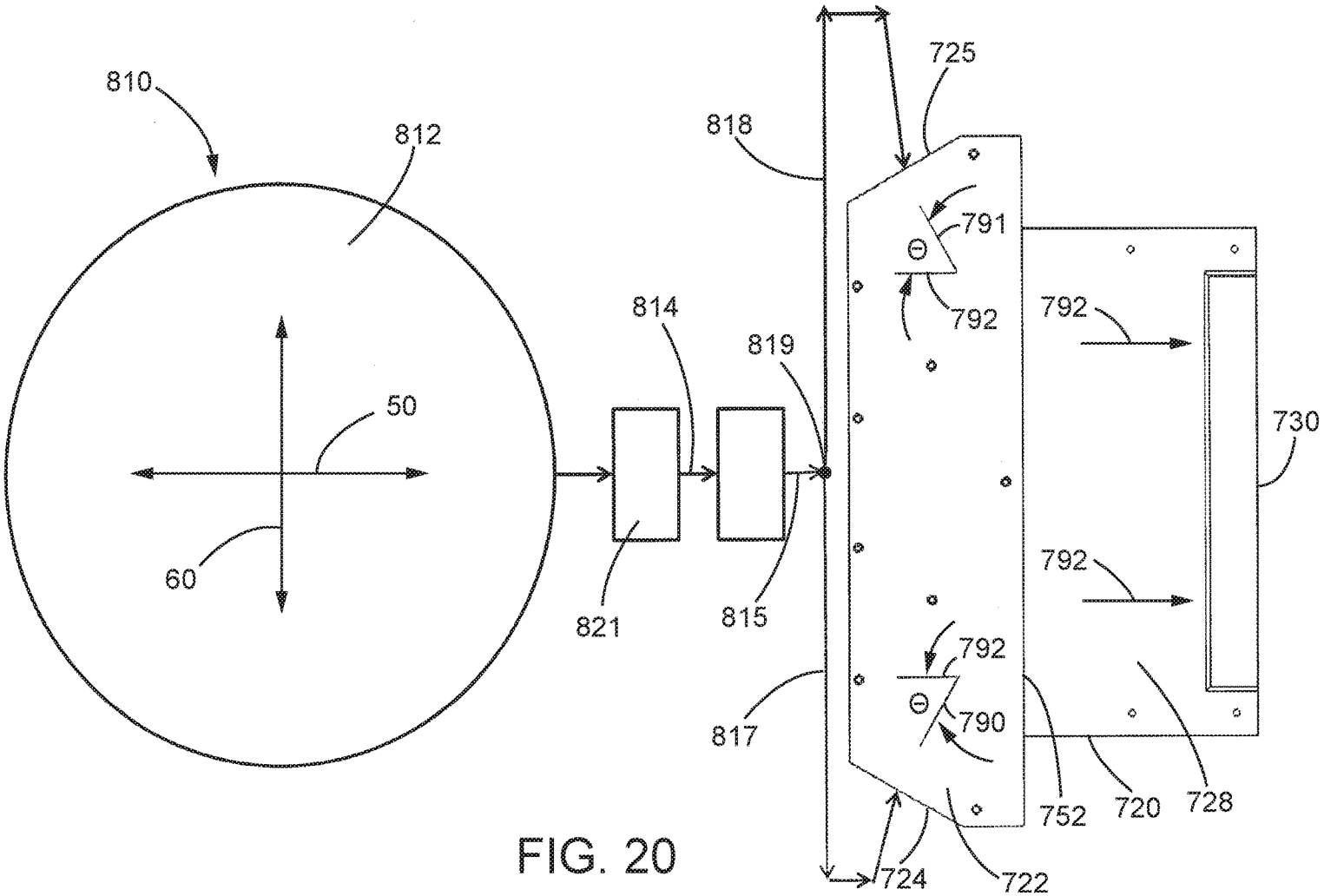
FIG. 20 is a schematic plan diagram of another embodiment of a gypsum slurry mixing and dispensing assembly including a slurry distributor in accordance with principles of the present disclosure.

Referring to FIG. 20, an embodiment of a gypsum slurry mixing and dispensing assembly 810 includes a gypsum slurry mixer 812 in fluid communication with the slurry distributor 720 of FIG. 13. The gypsum slurry mixer 812 is adapted to agitate water and calcined gypsum to form an aqueous calcined gypsum slurry. Both the water and the calcined gypsum can be supplied to the mixer 812 via one or more inlets as is known in the art. Any suitable mixer can be used with the slurry distributor.

The slurry distributor 720 is in fluid communication with the gypsum slurry mixer 812. The slurry distributor 720 includes a first feed inlet 724 adapted to receive a first flow of aqueous calcined gypsum slurry from the gypsum slurry mixer 812 moving in a first feed direction 790, a second feed inlet 725 adapted to receive a second flow of aqueous calcined gypsum slurry from the gypsum slurry mixer 812 moving in a second feed direction 791, and a distribution outlet 730 in fluid communication with both the first and the second feed inlets 724, 725 and adapted such that the first and second flows of aqueous calcined gypsum slurry discharge from the slurry distributor 720 through the distribution outlet 730 substantially along a machine direction 50.

The slurry distributor 720 includes a feed conduit 722 in fluid communication with a distribution conduit 728. The feed conduit includes the first feed inlet 724 and the second feed inlet 725 disposed in spaced relationship to the first feed inlet 724, which are both disposed at a feed angle θ of about 60° with respect to the machine direction 50. The feed conduit 722 includes structure therein adapted to receive the first and second flows of slurry moving in the first and second feed flow direction 790, 791 and redirect the slurry flow direction by a change in direction angle α (see FIG. 16)

such that the first and second flows of slurry are conveyed into the distribution conduit 728 moving substantially in the outlet flow direction 792, which is substantially aligned with the machine direction 50.

The distribution conduit 728 extends generally along the longitudinal axis or machine direction 50, which is substantially perpendicular to a transverse axis 60. The distribution conduit 728 includes an entry portion 752 and the distribution outlet 730. The entry portion 752 is in fluid communication with the first and second feed inlets 724, 725 of the feed conduit 722 such that the entry portion 752 is adapted to receive both the first and the second flows of aqueous calcined gypsum slurry therefrom. The distribution outlet 730 is in fluid communication with the entry portion 752. The distribution outlet 730 of the distribution conduit 728 extends a predetermined distance along the transverse axis 60 to facilitate the discharge of the combined first and second flows of aqueous calcined gypsum slurry in the cross-machine direction or along the transverse axis 60.

A delivery conduit 814 is disposed between and in fluid communication with the gypsum slurry mixer 812 and the slurry distributor 720. The delivery conduit 814 includes a main delivery trunk 815, a first delivery branch 817 in fluid communication with the first feed inlet 724 of the slurry distributor 720, and a second delivery branch 818 in fluid communication with the second feed inlet 725 of the slurry distributor 720. The main delivery trunk 815 is in fluid communication with both the first and second delivery branches 817, 818.

An aqueous foam supply conduit 821 can be in fluid communication with at least one of the gypsum slurry mixer 812 and the delivery conduit 814. An aqueous foam from a source can be added to the constituent materials through the foam supply conduit 821 at any suitable location downstream of the mixer 812 and/or in the mixer 812 itself to form a foamed gypsum slurry that is provided to the slurry distributor 720.

The main delivery trunk 815 can be joined to the first and second delivery branches 817, 818 via a suitable Y-shaped flow splitter 819. The flow splitter 819 is disposed between the main delivery trunk 815 and the first delivery branch 817 and between the main delivery trunk 815 and the second delivery branch 818. In some embodiments, the flow splitter 819 can be adapted to help split the first and second flows of gypsum slurry such that they are substantially equal. In other embodiments, additional components can be added to help regulate the first and second flows of slurry.

In use, an aqueous calcined gypsum slurry is discharged from the mixer 812. The aqueous calcined gypsum slurry from the mixer 812 is split in the flow splitter 819 into the first flow of aqueous calcined gypsum slurry and the second flow of aqueous calcined gypsum slurry. The aqueous calcined gypsum slurry from the mixer 812 can be split such that the first and second flows of aqueous calcined gypsum slurry are substantially balanced.

The gypsum slurry mixing and dispensing assembly 810 of FIG. 20 can be similar in other respects to the gypsum slurry mixing and dispensing assembly 110 of FIG. 6. It is further contemplated that slurry distributors constructed in accordance with principles of the present disclosure can be used in other embodiments of a gypsum slurry mixing and dispensing assembly as described herein.

Figure 21:
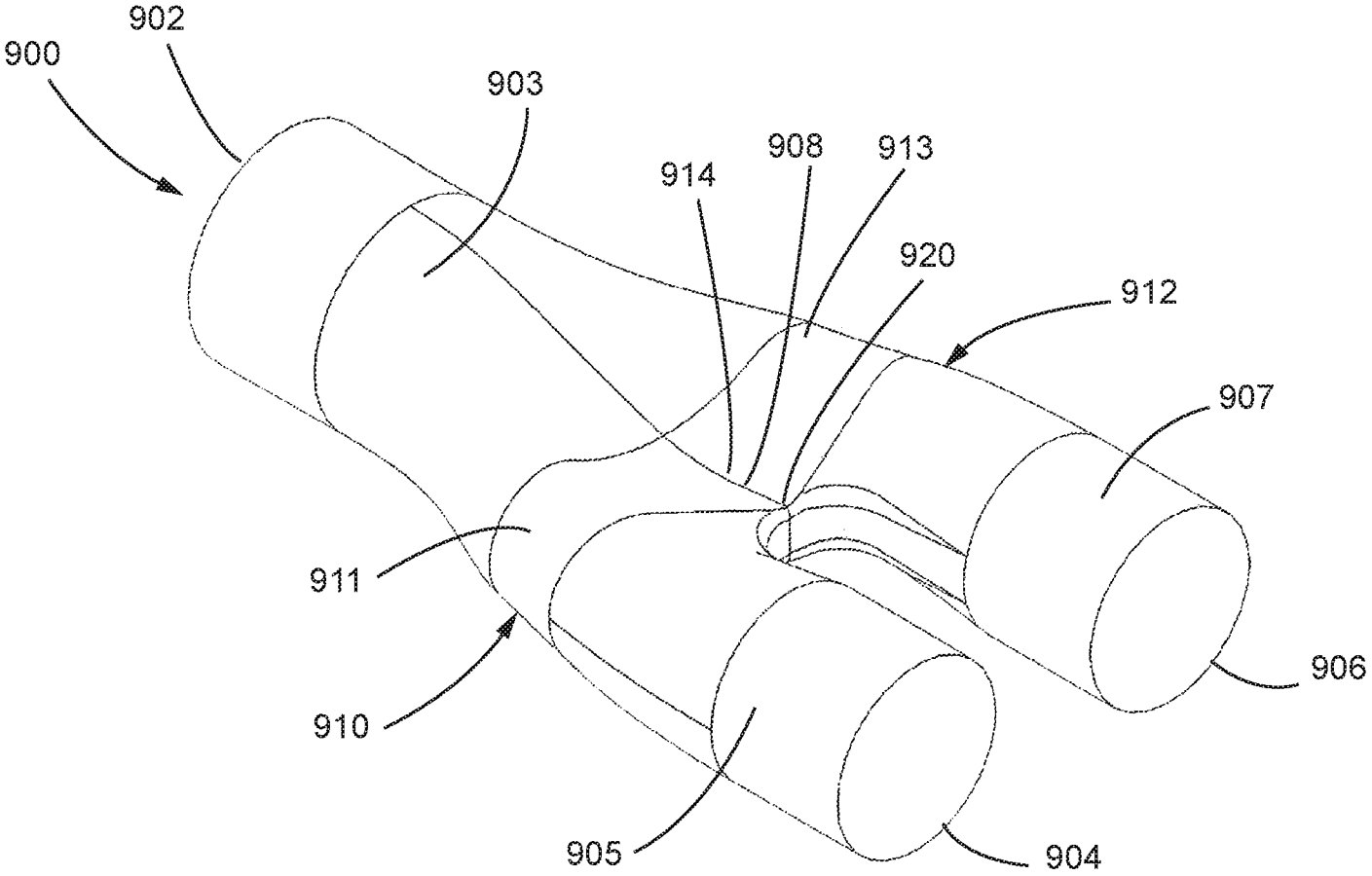
FIG. 21 is a perspective view of an embodiment of a flow splitter suitable for use in a gypsum slurry mixing and dispensing assembly including a slurry distributor in accordance with principles of the present disclosure.
Figure 22:
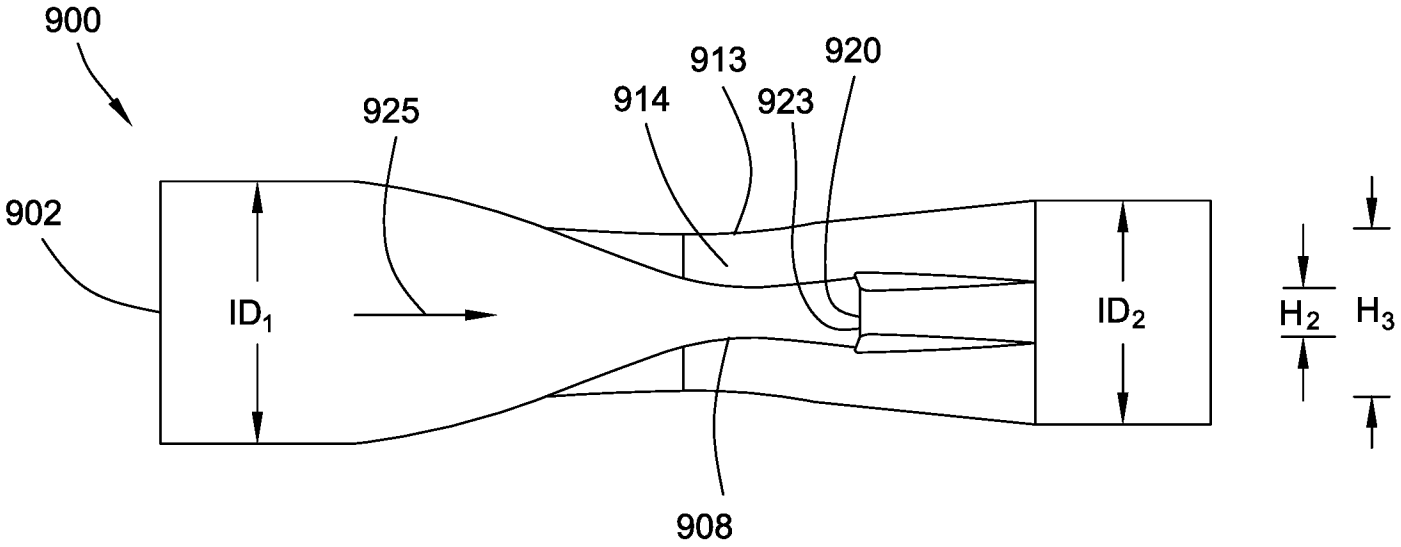
FIG. 22 is a side elevational view, in section, of the flow splitter of FIG. 21.

Referring to FIG. 21, an embodiment of a Y-shaped flow splitter 900 suitable for use in a gypsum slurry mixing and dispensing assembly constructed in accordance with principles of the present disclosure is shown. The flow splitter 900 can be placed in fluid communication with a gypsum slurry mixer and a slurry distributor such that the flow splitter 900 receives a single flow of aqueous calcined gypsum slurry from the mixer and discharges two separate flows of aqueous calcined gypsum slurry therefrom to the first and second feed inlets of the slurry distributor. One or more flow-modifying elements can be disposed between the mixer and the flow splitter 900 and/or between one or both of the delivery branches leading between the splitter 900 and the associated slurry distributor.

The flow splitter 900 has a substantially circular inlet 902 disposed in a main branch 903 adapted to receive a single flow of slurry and a pair of substantially circular outlets 904, 906 disposed respectively in first and second outlet branches 905, 907 that allow two flows of slurry to discharge from the splitter 900. The cross-sectional areas of the openings of the inlet 902 and the outlets 904, 906 can vary depending on the desired flow velocity. In embodiments where the cross-sectional areas of the openings of outlet 904, 906 are each substantially equal to cross-sectional area of the opening of the inlet 902, the flow velocity of the slurry discharging from each outlet 904, 906 can be reduced to about 50% of the velocity of the single flow of slurry entering the inlet 902 where the volumetric flow rate through the inlet 902 and both outlets 904, 906 is substantially the same.

In some embodiments, the diameter of the outlets 904, 906 can be made smaller than the diameter of the inlet 902 in order to maintain a relatively high flow velocity throughout the splitter 900. In embodiments where the cross-sectional areas of the openings of the outlets 904, 906 are each smaller than the cross-sectional area of the opening of the inlet 902, the flow velocity can be maintained in the outlets 904, 906 or at least reduced to a lesser extent than if the outlets 904, 906 and the inlet 902 all have substantially equal cross-sectional areas. For example, in some embodiments, the flow splitter 900 has the inlet 902 has an inner diameter ($ID_1$) of about 3 inches, and each outlet 904, 906 has an $ID_2$ of about 2.5 inches (though other inlet and outlet diameters can be used in other embodiments). In an embodiment with these dimensions at a line speed of 350 fpm, the smaller diameter of the outlets 904, 906 causes the flow velocity in each outlet to be reduced by about 28% of the flow velocity of the single flow of slurry at the inlet 902.

The flow splitter 900 can includes a recessed central portion 914 and a junction 920 between the first and second outlet branches 905, 907. The recessed central portion 914 creates a restriction 908 in the central interior region of the flow splitter 900 upstream of the junction 920 that helps promote flow to the outer edges 910, 912 of the splitter to reduce the occurrence of slurry buildup at the junction 920. The shape of the recessed central portion 914 results in guide channels 911, 913 adjacent the outer edges 910, 912 of the flow splitter 900. The restriction 908 in the recessed central portion 914 has a smaller height $H_2$ than the height $H_3$ of the guide channels 911, 913. The guide channels 911, 913 have a cross-sectional area that is larger than the cross-sectional area of the central restriction 908. As a result, the flowing slurry encounters less flow resistance through the guide channels 911, 913 than through the central restriction 908, and flow is directed toward the outer edges of the splitter junction 920.

The junction 920 establishes the openings to the first and second outlet branches 905, 907. The junction 920 is made up of a planar wall surface 923 that is substantially perpendicular to an inlet flow direction 925.

Figure 23:
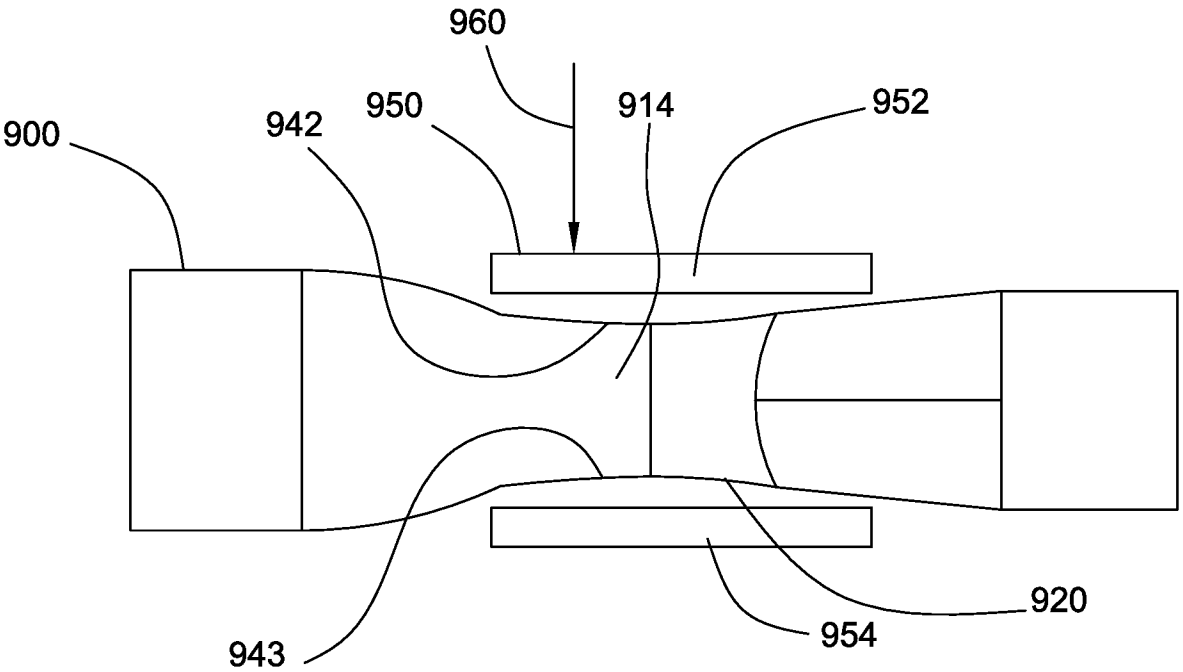
FIG. 23 is a side elevational view of the flow splitter of FIG. 21 with an embodiment of a squeezing apparatus mounted thereto.

Referring to FIG. 23, in some embodiments, an automatic device 950 for squeezing the splitter 900 at adjustable and regular time intervals can be provided to prevent solids building up inside the splitter 900. In some embodiments, the squeezing apparatus 950 can include a pair of plates 952, 954 disposed on opposing sides 942, 943 of the recessed central portion 914. The plates 952, 954 are movable relative to each other by a suitable actuator 960. The actuator 960 can be operated either automatically or selectively to move the plates 952, 954 together relative to each other to apply a compressive force upon the splitter 900 at the recessed central portion 914 and the junction 920.

When the squeezing apparatus 950 squeezes the flow splitter, the squeezing action applies compressive force to the flow splitter 900, which flexes inwardly in response. This compressive force can help prevent buildup of solids inside the splitter 900 which may disrupt the substantially equally split flow to the slurry distribution through the outlets 904, 906. In some embodiments, the squeezing apparatus 950 is designed to automatically pulse through the use of a programmable controller operably arranged with the actuators. The time duration of the application of the compressive force by the squeezing apparatus 950 and/or the interval between pulses can be adjusted. Furthermore, the stroke length that the plates 952, 954 travel with respect to each other in a compressive direction can be adjusted.

Embodiments of a slurry distributor, a gypsum slurry mixing and dispensing assembly, and methods of using the same are provided herein which can provide many enhanced process features helpful in manufacturing gypsum wallboard in a commercial setting. A slurry distributor constructed in accordance with principles of the present disclosure can facilitate the spreading of aqueous calcined gypsum slurry upon a moving web of cover sheet material as it advances past a mixer at the wet end of the manufacturing line toward a forming station.

A gypsum slurry mixing and dispensing assembly constructed in accordance with principles of the present disclosure can split a flow of aqueous calcined gypsum slurry from a mixer into two separate flows of aqueous calcined gypsum slurry which can be recombined downstream in a slurry distributor constructed in accordance with principles of the present disclosure to provide a desired spreading pattern. The design of the dual inlet configuration and the distribution outlet can allow for wider spreading of more viscous slurry in the cross-machine direction over the moving web of cover sheet material. The slurry distributor can be adapted such that the two separate flows of aqueous calcined gypsum slurry enter a slurry distributor along feed inlet directions which include a cross-machine direction component, are re-directed inside the slurry distributor such that the two flows of slurry are moving in substantially a machine direction, and are recombined in the distributor in a way to enhance the cross-direction uniformity of the combined flows of aqueous calcined gypsum slurry being discharged from the distribution outlet of the slurry distributor to help reduce mass flow variation over time along the transverse axis or cross machine direction. Introducing the first and second flows of aqueous calcined gypsum slurry in first and second feed directions that include a cross-machine directional component can help the re-combined flows of slurry discharge from the slurry distributor with a reduced momentum and/or energy.

The interior flow cavity of the slurry distributor can be configured such that each of the two flows of slurry move through the slurry distributor in a streamline flow. The interior flow cavity of the slurry distributor can be configured such that each of the two flows of slurry move through the slurry distributor with minimal or substantially no air-liquid slurry phase separation. The interior flow cavity of the slurry distributor can be configured such that each of the two flows of slurry move through the slurry distributor substantially without undergoing a vortex flow path.

A gypsum slurry mixing and dispensing assembly constructed in accordance with principles of the present disclosure can include flow geometry upstream of the distribution outlet of the slurry distributor to reduce the slurry velocity in one or multiple steps. For example, a flow splitter can be provided between the mixer and the slurry distributor to reduce the slurry velocity entering the slurry distributor. As another example, the flow geometry in the gypsum slurry mixing and dispensing assembly can include areas of expansion upstream and within the slurry distributor to slow down the slurry so it is manageable when it is discharged from the distribution outlet of the slurry distributor.

The geometry of the distribution outlet can also help control the discharge velocity and momentum of the slurry as it is being discharged from the slurry distributor upon the moving web of cover sheet material. The flow geometry of the slurry distributor can be adapted such that the slurry discharging from the distribution outlet is maintained in substantially a two-dimensional flow pattern with a relatively small height in comparison to the wider outlet in the cross-machine direction to help improve stability and uniformity.

The relatively wide discharge outlet yields a momentum per unit width of the slurry being discharged from the distribution outlet that is lower than the momentum per unit width of a slurry discharged from a conventional boot under similar operating conditions. The reduced momentum per unit width can help prevent washout of a skim coat of a dense layer applied to the web of cover sheet material upstream from the location where the slurry is discharged from the slurry distributor upon the web.

In the situation where a conventional boot outlet is 6 inches wide and 2 inches thick is used, the average velocity of the outlet for a high volume product is 761 ft/min. In embodiments where the slurry distributor constructed in accordance with principles of the present disclosure includes a distribution outlet having an opening that is 24 inches wide and 0.75 inches thick, the average velocity is 550 ft/min. The mass flow rate is the same for both devices at 3,437 lb/min. The momentum of the slurry (mass flow rate*average velocity) for both cases would be ~2,618,000 and 1,891,000 $lb \cdot ft/min^2$ for the conventional boot and the slurry distributor, respectively. Dividing the respective calculated momentum by the widths of the conventional boot outlet and the slurry distributor outlet, the momentum per unit width of the slurry discharging from the convention boot is 402,736 $(lb \cdot ft/min^2)$/(inch across boot width), and the momentum per unit width of the slurry discharging from the slurry distributor constructed in accordance with principles of the present disclosure is 78,776 $(lb \cdot ft/min^2)$/(inch across slurry distributor width). In this case, the slurry discharging from the slurry distributor has about 20% of the momentum per unit width compared to the conventional boot.

A slurry distributor constructed in accordance with principles of the present disclosure can achieve a desired spreading pattern while using an aqueous calcined gypsum slurry over a broad range of water-stucco ratios, including a relatively low WSR or a more conventional WSR, such as, a water-to-calcined gypsum ratio from about 0.4 to about 1.2, for example, below 0.75 in some embodiments, and between about 0.4 and about 0.8 in other embodiments. Embodiments of a slurry distributor constructed in accordance with principles of the present disclosure can include internal flow geometry adapted to generate controlled shear effects upon the first and second flows of aqueous calcined gypsum slurry as the first and second flows advance from the first and second feed inlets through the slurry distributor toward the distribution outlet. The application of controlled shear in the slurry distributor can selectively reduce the viscosity of the slurry as a result of being subjected to such shear. Under the effects of controlled shear in the slurry distributor, slurry having a lower water-stucco ratio can be distributed from the slurry distributor with a spread pattern in the cross-machine direction comparable to slurries having a conventional WSR.

The interior flow geometry of the slurry distributor can be adapted to further accommodate slurries of various water-stucco ratios to provide increase flow adjacent the boundary wall regions of the interior geometry of the slurry distributor. By including flow geometry features in the slurry distributor adapted to increase the degree of flow around the boundary wall layers, the tendency of slurry to re-circulate in the slurry distributor and/or stop flowing and set therein is reduced. Accordingly, the build up of set slurry in the slurry distributor can be reduced as a result.

A slurry distributor constructed in accordance with principles of the present disclosure can include a profile system mounted adjacent the distribution outlet to alter a cross machine velocity component of the combined flows of slurry discharging from the distribution outlet to selectively control the spread angle and spread width of the slurry in the cross machine direction on the substrate moving down the manufacturing line toward the forming station. The profile system can help the slurry discharged from the distribution outlet achieve a desired spread pattern while being less sensitive to slurry viscosity and WSR. The profile system can be used to change the flow dynamics of the slurry discharging from the distribution outlet of the slurry distributor to guide slurry flow such that the slurry has more uniform velocity in the cross-machine direction. Using the profile system can also help a gypsum slurry mixing and dispensing assembly constructed in accordance with principles of the present disclosure be used in a gypsum wallboard manufacturing setting to produce wallboard of different types and volumes.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of distributing an aqueous calcined gypsum slurry upon a web of cover sheet material moving along a machine direction, the method comprising:

discharging an aqueous calcined gypsum slurry from a mixer;

splitting the aqueous calcined gypsum slurry from the mixer into a first flow of aqueous calcined gypsum slurry and a second flow of aqueous calcined gypsum slurry;

passing the first flow of aqueous calcined gypsum slurry through a first feed inlet of a slurry distributor;

passing the second flow of aqueous calcined gypsum slurry through a second feed inlet of the slurry distributor, the second feed inlet in spaced relationship to the first feed inlet;

combining the first and second flows of aqueous calcined gypsum slurry in the slurry distributor; and discharging the combined first and second flows of aqueous calcined gypsum slurry from the slurry distributor upon the moving web.

2. The method of distributing an aqueous calcined gypsum slurry upon a moving web of claim 1, wherein the combined first and second flows of aqueous calcined gypsum slurry are discharging at an average discharge velocity, and the web of cover sheet material is moving along the machine direction at a web velocity, wherein the ratio of the average discharge velocity to the web velocity is about 2 or less.

3. The method of distributing an aqueous calcined gypsum slurry upon a moving web of claim 1, wherein the combined first and second flows of aqueous calcined gypsum slurry discharge from the slurry distributor through a distribution outlet, the web has a width extending along a cross-machine direction substantially perpendicular to the machine direction, and the distribution outlet includes an outlet opening with a width extending along the cross-machine direction and sized such that the ratio of the width of the cover sheet to the width of the outlet opening of the distribution outlet is within a range from about 1 to about 6.

4. The method of distributing an aqueous calcined gypsum slurry upon a moving web of claim 1, further comprising:

mixing and agitating water and calcined gypsum in a water-to-calcined gypsum ratio from about 0.4 to about 1.2 to form the first and second flows of aqueous calcined gypsum slurry.

5. The method of distributing an aqueous calcined gypsum slurry upon a moving web of claim 1, wherein the combined first and second flows of aqueous calcined gypsum slurry discharge from the slurry distributor through a distribution outlet and form a spread pattern upon the moving web, the method further comprising:

adjusting at least one of the size and shape of the distribution outlet to change the spread pattern.

6. The method of distributing an aqueous calcined gypsum slurry upon a moving web of claim 1, wherein the first and second flows of aqueous calcined gypsum slurry combine in the slurry distributor such that the combined first and second flows of aqueous calcined gypsum slurry move in a distribution direction generally along the machine direction.

7. The method of distributing an aqueous calcined gypsum slurry upon a moving web of claim 1, wherein the first flow of aqueous calcined gypsum slurry passes through the first feed inlet in a first feed direction, and the second flow of aqueous calcined gypsum slurry passes through the second feed inlet in a second feed direction, the method further comprising:

redirecting in the slurry distributor the first flow of slurry moving in the first feed flow direction through a change in direction angle in a range up to about 135° to an outlet flow direction;

redirecting in the slurry distributor the second flow of slurry moving in the second feed flow direction through a change in direction angle in a range up to about 135° to the outlet flow direction;

wherein the combined first and second flows of aqueous calcined gypsum slurry discharge from the slurry distributor moving generally in the outlet flow direction.

8. The method of distributing an aqueous calcined gypsum slurry upon a moving web of claim 7, wherein the outlet flow direction is substantially parallel to the machine direction.

9. The method of distributing an aqueous calcined gypsum slurry upon a moving web of claim 1, wherein the aqueous calcined gypsum slurry from the mixer is split such that the first and second flows of aqueous calcined gypsum slurry are substantially balanced.

* * * * *